US011959212B2

(12) United States Patent
Mead

(10) Patent No.: US 11,959,212 B2
(45) Date of Patent: Apr. 16, 2024

(54) ALIGNMENT DEVICE FOR SEWING ALIGNMENT

(71) Applicant: Allison Mead, Jacksonville, FL (US)

(72) Inventor: Allison Mead, Jacksonville, FL (US)

( * ) Notice: Subject to any disclaimer, the term of this patent is extended or adjusted under 35 U.S.C. 154(b) by 77 days.

(21) Appl. No.: 17/881,515

(22) Filed: Aug. 4, 2022

(65) Prior Publication Data

US 2024/0044061 A1 Feb. 8, 2024

(51) Int. Cl.
*D05B 35/02* (2006.01)

(52) U.S. Cl.
CPC ..... *D05B 35/02* (2013.01)

(58) Field of Classification Search
CPC ..... D05B 35/02; D05B 35/10; D05B 35/04
USPC ..... 33/563, 565
See application file for complete search history.

(56) References Cited

U.S. PATENT DOCUMENTS 4,642,896 A * 2/1987 Grimm ..... A41H 3/00 33/562
6,276,070 B1 * 8/2001 Hawley ..... D05B 97/12 33/1 G
7,730,842 B1 * 6/2010 Sebrow ..... D06H 7/00 112/475.08
8,408,150 B1 * 4/2013 Ragan ..... D05B 97/00 112/136
8,833,281 B2 * 9/2014 Widell ..... D05C 7/08 112/103
10,781,545 B2 * 9/2020 Massey ..... B25H 7/02

* cited by examiner

*Primary Examiner* — Tajash D Patel
(74) *Attorney, Agent, or Firm* — Wilson Dutra, PLLC; Camille A. Wilson

(57) ABSTRACT

The present disclosure provides for an alignment device used in sewing projects, such as the construction of an inseam. The alignment device may comprise at least one tip, at least one sleeve, and one or more holes. When the alignment device comprises one or more holes, the one or more holes may allow for storage on a wall or other surface via an external hook or knob. The alignment device may further comprise one or more extensions. When the alignment device comprises one or more extensions, the one or more extensions may be coupled to the alignment device via at least one extension mechanism. One alignment device may interface with other alignment devices in a nesting alignment system. When a nesting alignment system is implemented, one or more of the alignment devices may comprise a recess to house at least one smaller alignment device therein for storage purposes. The alignment device may comprise a plastic, wooden, vinyl, or magnetic material, or any combination thereof.

10 Claims, 20 Drawing Sheets

1000

1400

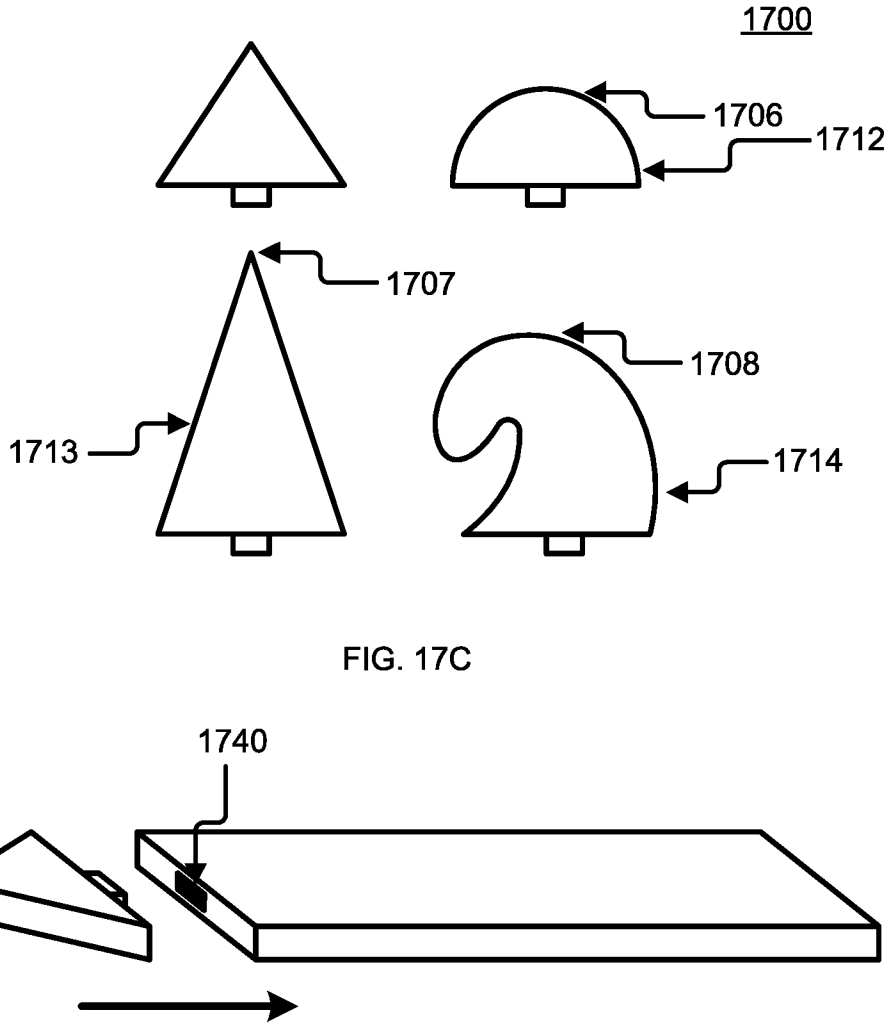
FIG. 17C
FIG. 17D
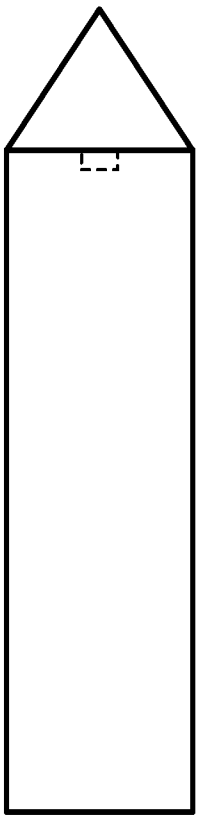
FIG. 17B
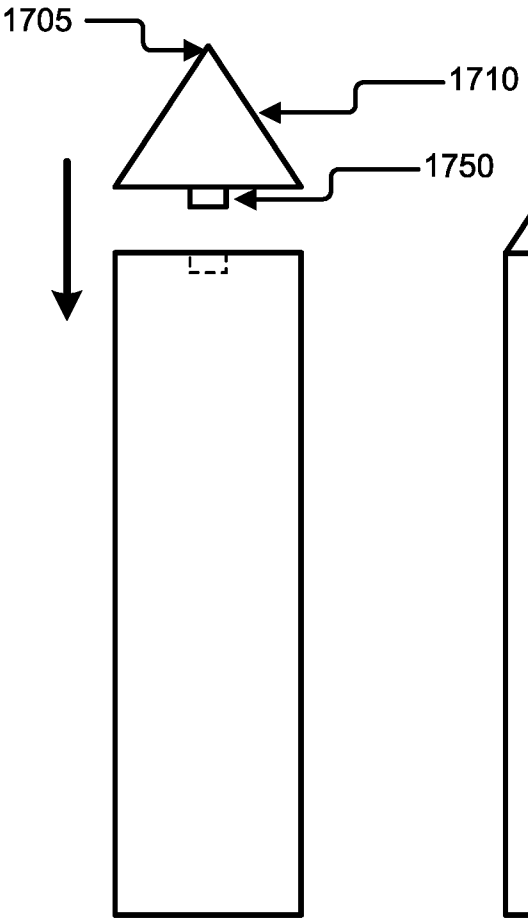
FIG. 17A

ALIGNMENT DEVICE FOR SEWING ALIGNMENT

CROSS-REFERENCE TO RELATED APPLICATION

This application claims priority to and the full benefit of United States Non-provisional Patent Application Ser. No. 63/229,542 (filed Aug. 5, 2021, and titled "ALIGNMENT DEVICE FOR SEWING ALIGNMENT"), the entire contents of which are incorporated herein by reference.

BACKGROUND

Sewing, embroidery, and needlepoint are all important skills that often present unique challenges. Patience, close attention to detail, and a careful eye are just a few of the many requirements for mastery of these activities. One of the many ever-present challenges associated with sewing clothing involves aligning inseams along tubed fabric, such as for a sleeve, dress sinch-tie, or pant leg. Sewing children's clothing can be particularly tricky, as their sizing is often small, making the designs harder to maneuver.

Alignment of inseams is necessary for a number of reasons. First, proper alignment ensures an article of clothing is comfortable to wear, moves about the wearer as intended, and is as aesthetically pleasing as possible. Second, proper alignment ensures the inseams lay flat and do not bubble up, creating bumps in the clothing. Typically, inseams have a seam allowance, or an internal excess of fabric to ensure a secure seam, of around a quarter of an inch (sometimes as much as half an inch for some types of clothing). Seam allowances are a crucial part of any sewing project as they incorporate extra fabric into the design. In the instance of a piece of clothing, seam allowances ensure consistency in fit and longevity in wear. Without a proper seam allowance, clothing may unravel or fit incorrectly.

Since seam allowances are arguably the most important part of any sewing project, they are often one of the most tedious and difficult parts of the process. For small-shop owners and clothing manufacturers, it can take anywhere from a few to ten minutes to ensure one article has proper inseam alignment. When mass-producing clothing, these minutes add up, prolonging the process and hindering overall productivity. Even when manual alignment can be achieved with enough time and patience, it is often unreliable for producing consistent results. While it is often the "human-touch" to sewing and other needlework projects that make them so endearing, the resulting imperfections can be frustrating when trying to produce as many pieces of clothing as possible in a consistent way and in a reasonable amount of time.

SUMMARY OF THE DISCLOSURE

What is needed is a device that streamlines the inseam alignment process as efficiently and consistently as possible. Accordingly, the present disclosure provides for an insertable alignment device for use in sewing projects, such as the construction of an inseam. In some aspects, an alignment device may be inserted inside a constructed tube of fabric and pushed against an inseam to keep it straight as the piece is finalized. The alignment device may properly align inseams in a timely fashion, such, for example and not limitation, in approximately thirty seconds, thereby expediting the entire sewing process, especially in the case of mass production of articles of clothing, such as dresses, pants, sweaters, and more. This may be particularly useful when ironing the inseams to make them smooth and straight. The alignment device may comprise a variety of sizes and materials, allowing the device to be used for multiple or specific projects, such as the manufacture of children's clothing, as well enabling the alignment device to interface with one or more various external devices, such as an iron.

In some embodiments, the alignment device may comprise at least one tip, a sleeve, and one or more holes. When the alignment device comprises one or more holes, one or more of the holes may allow the alignment device to be stored on a wall or other surface via an external hook or knob. In some implementations, the alignment device may comprise one or more extensions. When the alignment device comprises one or more extensions, each of the extensions may be coupled to the alignment device via at least one extension mechanism.

In some aspects, one alignment device may interface with one or more additional alignment devices in a nesting alignment system. Within such a nesting alignment system, one or more of the alignment devices may comprise a recess configured to house a smaller alignment device therein for storage purposes.

In some implementations, the alignment device of the present disclosure may comprise a plastic, wooden, vinyl, or magnetic material, or any combination thereof. In some embodiments, the alignment device may at least partially comprise a heat-resistant or thermoregulating material so it may interface with an external device, such as an iron.

BRIEF DESCRIPTION OF THE DRAWINGS

The accompanying drawings that are incorporated in and constitute a part of this specification illustrate several embodiments of the disclosure and, together with the description, serve to explain the principles of the disclosure:

FIG. 17A illustrates an exemplary alignment device comprising a connecting body that further comprises a tip, according to some embodiments in the present disclosure.

FIG. 17B illustrates an exemplary alignment device comprising a connecting body that further comprises a tip, according to some embodiments in the present disclosure.

FIG. 17C illustrates a plurality of exemplary tips for an exemplary alignment device, according to some embodiments in the present disclosure.

FIG. 17D illustrates a perspective view of an exemplary alignment device comprising a connecting body that further comprises a tip, according to some embodiments in the present disclosure.

DETAILED DESCRIPTION

In the following sections, detailed descriptions of examples and methods of the disclosure will be given. The descriptions of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Alignment: as used herein, refers to the action or state of something being aligned. For example, an alignment device may allow a user to ensure external fabrics or materials are properly aligned when sewing or stitching. Alignment may be determined via a plurality of measuring systems or indicators, either included on or interfaced with the alignment device.

Cavity: as used herein, refers to an internal depression within the body of an alignment device that may house one or more extensions therein when the one or more extensions is not in a partially or fully extended position.

Extension: as used herein, refers to a movable component of an alignment device that may be used to manually adjust to the length or width of the alignment device. An extension may be partially extended incrementally or freely until a fully extended position is reached.

Extension mechanism: as used herein, refers to a mechanism that attaches one or more extensions to an alignment device and allows the one or more extensions to swivel, rotate, elongate, slide, move, or undergo other similar motions. In some embodiments, an extension mechanism may at least partially comprise a hinge, a swivel hinge, a snap system, or a spring.

The present disclosure describes an alignment device used in sewing and other needlework. The alignment device may facilitate the proper alignment of two or more parts of a project, such as when forming an inseam for an article of clothing, in a consistent, reliable, and efficient way. This proper alignment may allow the inseam to become smooth and even when the inseam is ironed after the sewing is complete.

Figure 1B:
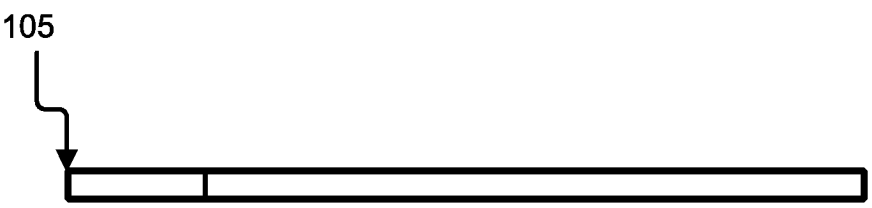
FIG. 1B illustrates a side view of an exemplary alignment device, according to some embodiments in the present disclosure.
Figure 1A:
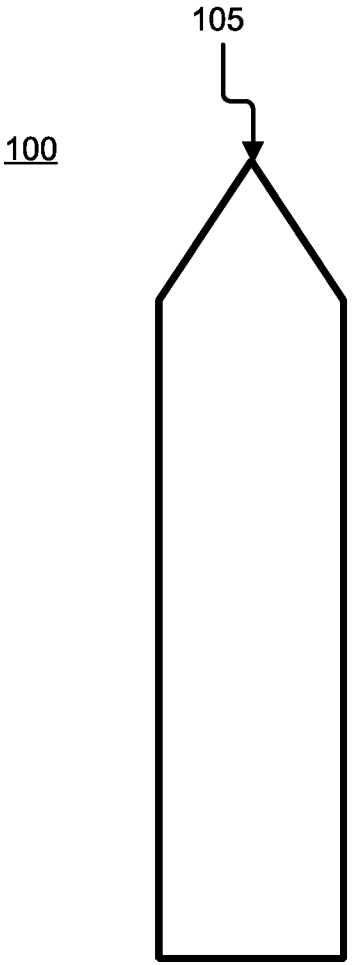
FIG. 1A illustrates an exemplary alignment device, according to some embodiments in the present disclosure.

Referring now to FIGS. 1A-B, an exemplary alignment device 100 is illustrated. In some embodiments, the alignment device 100 may comprise at least one tip 110. In some implementations, the alignment device 100 may comprise one or more materials, such as plastic, wood, vinyl, or other non-limiting examples, as well as any combination thereof. In some aspects, the alignment device 100 may at least partially comprise a magnetic material, so that fabrics and other materials may be secured to the alignment device with external magnets during use. This additional means of securing the fabric to the alignment device 100 may assist in facilitating the proper alignment of inseams to produce a product that is sized and shaped as intended.

In some embodiments, the tip 105 may guide the alignment device 100 into position. In some implementations, the alignment device 100 may comprise one or more measurement systems adhered to, painted on, engraved in, or otherwise marked on its top surface to aid a user in measuring fabrics or other materials when the alignment device 100 is in use. For example, a user may want to use the alignment device 100 to align an inseam for or of a particular length. The one or more measurement systems integrated into the alignment device 100 may allow the user to use less tools at once.

In some aspects, the alignment device 100 may comprise a lighting system so a fabric may be backlit when draped over the alignment device 100, to aid in measuring. This lighting system may be battery-operated or rechargeable via an external device. For example, the lighting system may illuminate multiple layers of fabric comprising multiple inseams. Instead of having to align each layer separately, the user may be able to align them all at one time with the alignment device 100. The lighting system may also be beneficial in joining several pieces of fabric or parts of an article to one inseam. This lighting system may also facilitate the formation of a straight seam while ironing the inseam.

In some embodiments, the alignment device 100 may comprise a first body, where the first body comprises a first distal end, the first distal end of the first body comprising the tip 105, wherein one or more edges of the first distal end of the first body converge at the tip 105. In some aspects, the first body may comprise a second distal end, wherein the second distal end of the first body may comprise one or more edge portions. In some implementations, the first body may comprise a top planar surface, wherein the top planar surface of the first body comprises a smooth, continuous plane that spans an area bounded by the first distal end of the first body, the second distal end of the first body, and two substantially straight side portions on opposing sides of the first body and extending from the first distal end of the first body to the second distal end of the first body.

In some aspects, the first body may comprise a bottom planar surface, wherein the bottom planar surface of the first body is congruent with the top planar surface of the first body and spans the area bounded by the first distal end of the first body, the second distal end of the first body, and the two straight side portions of the first body.

In some implementations, the alignment device 100 may comprise at least one connecting body. In some aspects, the at least one connecting body may comprise a first distal end and a second distal end, wherein the first distal end of the at least one connecting body comprises at least one connection mechanism, wherein the at least one connection mechanism attaches the at least one connecting body to a receiving portal configured within the second distal end of the first body or an adjacent connecting body.

In some embodiments, the at least one connecting body may comprise a top planar surface, wherein the top planar surface of the at least one connecting body comprises a smooth, continuous plane that spans an area bounded by the first distal end of the at least one connecting body, the second distal end of the at least one connecting body, and two substantially straight side portions on opposing sides of the at least one connecting body and extending from the first distal end of the at least one connecting body to the second distal end of the at least one connecting body.

In some aspects, the top planar surface of the at least one connecting body is congruent with the top planar surface of the first body. In some implementations, the second distal end of the at least one connecting body may comprise at least one receiving portal, wherein the at least one receiving portal may be configured to removably receive a connection mechanism of an adjacent connecting body. In some embodiments, the top planar surface of the at least one connecting body may be parallel to the top planar surface of the first body and/or the top planar surface of an adjacent connecting body when the at least one connecting body is attached thereto.

Figure 2A:
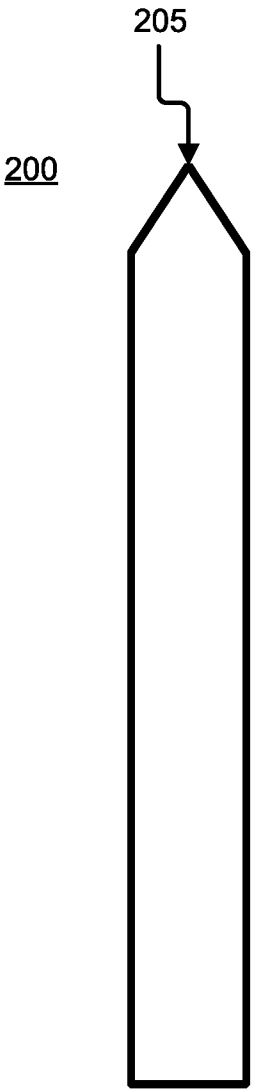
FIG. 2A illustrates an exemplary alignment device, according to some embodiments in the present disclosure.
Figure 2B:
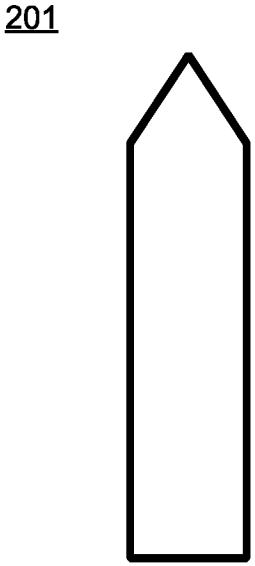
FIG. 2B illustrates an exemplary alignment device, according to some embodiments in the present disclosure.
Figure 2C:
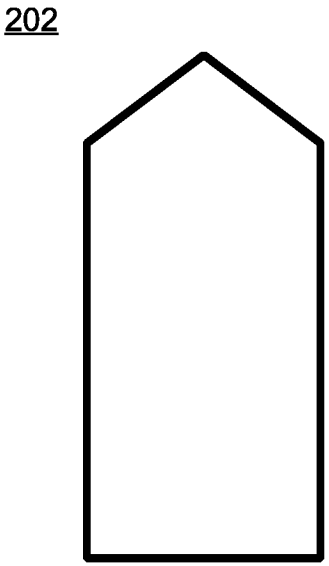
FIG. 2C illustrates an exemplary alignment device, according to some embodiments in the present disclosure.

Referring now to FIGS. 2A-C, an exemplary alignment device 200, 201, 202 is illustrated. In some embodiments, the alignment device 200 may comprise at least one tip 205. The alignment device 200, 201, 202 may comprise different sizes for different project needs. For example, a longer, narrower alignment device 200 may be more helpful in constructing sleeves for tapestries or adult-sized long-sleeve shirts or sweaters, as non-limiting examples. In some implementations, a smaller, narrower alignment device 201 may be more helpful in constructing sleeves for baby blankets or child-sized long-sleeve shirts or sweaters, as non-limiting examples. In some aspects, a shorter, wider alignment device 202 may be more helpful in constructing the bodies of shirts and dresses, as non-limiting examples.

Figure 3A:
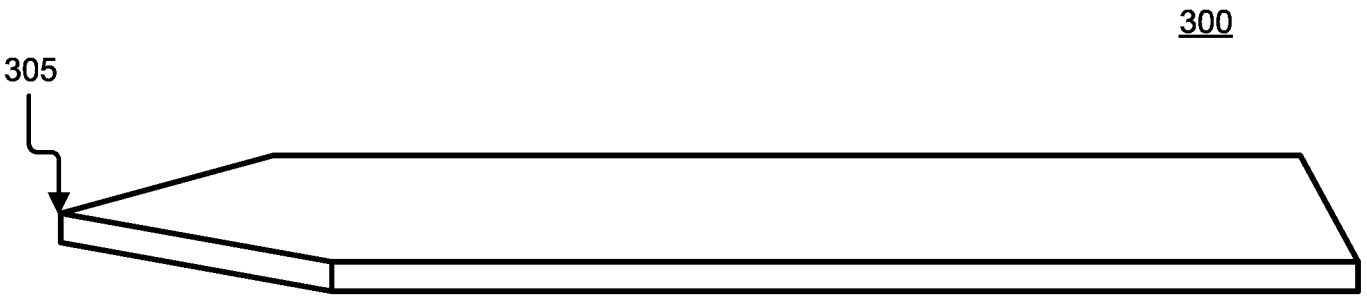
FIG. 3A illustrates a perspective view of an exemplary alignment device, according to some embodiments in the present disclosure.
Figure 3B:
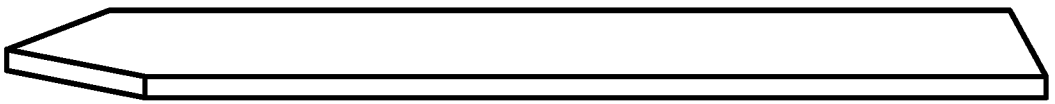
FIG. 3B illustrates a perspective view of an exemplary alignment device, according to some embodiments in the present disclosure.
Figure 3C:
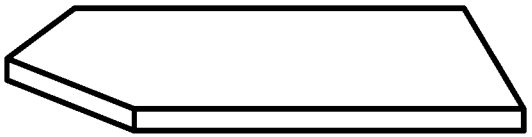
FIG. 3C illustrates a perspective view of an exemplary alignment device, according to some embodiments in the present disclosure.

Referring now to FIGS. 3A-C, an exemplary alignment device 300, 301, 302 is illustrated. In some embodiments, the alignment device 300 may comprise at least one tip 305. In some embodiments, the alignment device 300, 301, 302 may comprise different sizes for different project needs. For example, children's clothing is usually smaller than adult clothing; therefore, a smaller alignment device 302 may be better suited for projects involving children's clothing.

Figures 4A, 4B:
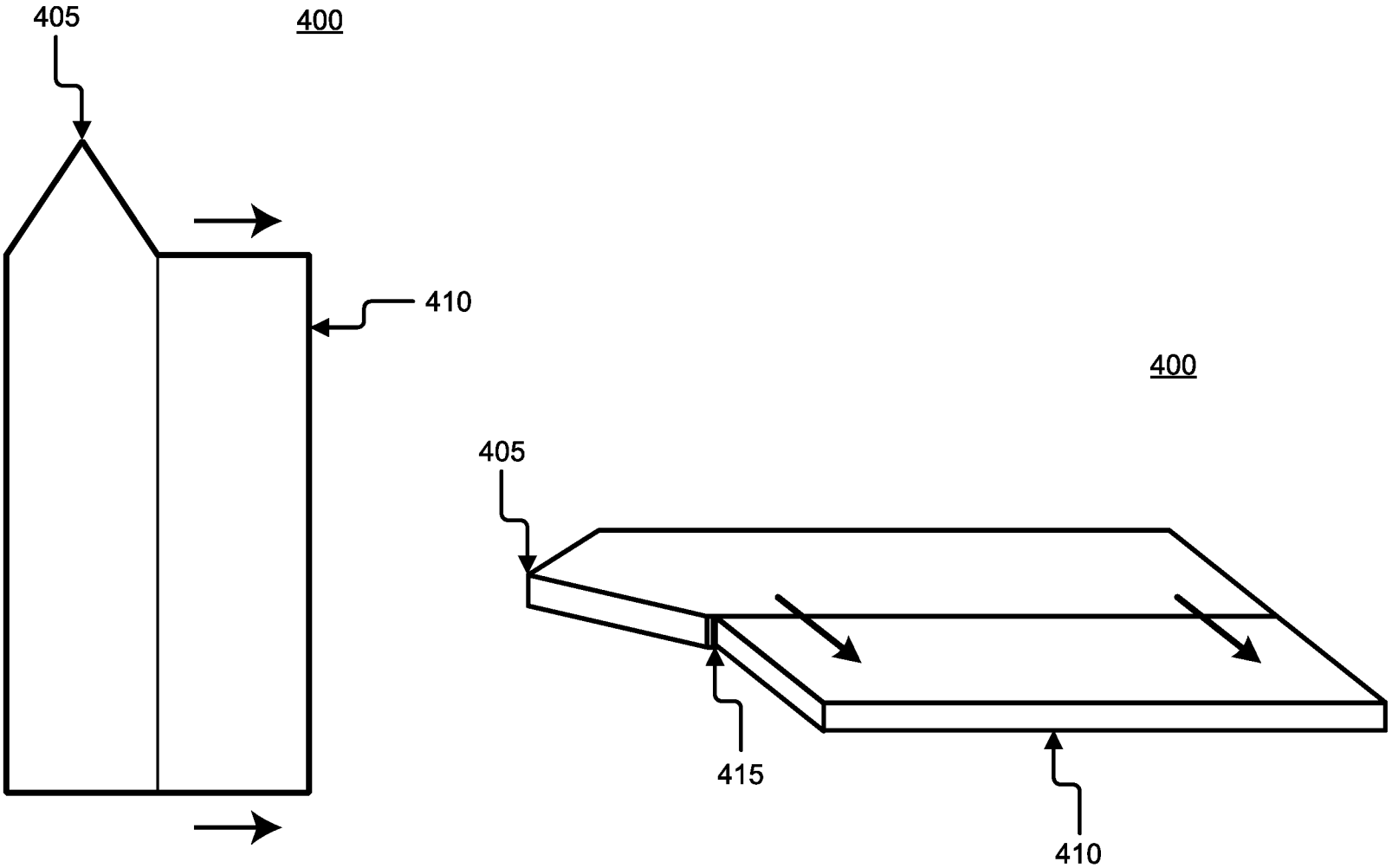
FIG. 4A illustrates an exemplary alignment device comprising an extension, according to some embodiments in the present disclosure.
FIG. 4B illustrates a perspective view of an exemplary alignment device comprising an extension, according to some embodiments in the present disclosure.

Referring now to FIGS. 4A-B, an exemplary alignment device 400 is illustrated. In some embodiments, the alignment device 400 may comprise at least one tip 405 and at least one internal cavity. In some implementations, the alignment device 400 may comprise one or more extensions 410. In some aspects, the extension 410 may be coupled to the alignment device 400 by at least one extension mechanism 415.

In some embodiments, the extension 410 may comprise a first, retracted position and a second, fully extended position. In some implementations, the extension 410 may be housed within the internal cavity of the alignment device 400 when in the first, retracted position. In some aspects, when the extension 410 is in the second, fully extended position, the extension 410 may be fully extended from the alignment device 400 and may function to increase the overall surface area of the alignment device 400. In some embodiments, when the extension 410 is in the second, fully extended position, the overall surface area of the alignment device 400 may be doubled.

In some embodiments, an extension mechanism 415 may facilitate the movement of the extension 410 from the first, retracted position to the second, fully extended position. In some aspects, the extension 410 may incrementally or freely occupy a plurality of positions between the first, retracted position and the second, fully extended position. In some implementations, the extension 410 may comprise one or more smaller, collapsible segments that may be stored in a collapsed state that, when coupled together, may more than double the surface area of alignment device 400 in any direction.

In some embodiments, the extension mechanism 415 may at least partially comprise a hinge, snap system, spring or other non-limiting equivalents. In some implementations, the alignment device 400 may also comprise at least one securing mechanism, such as, by way of example and not limitation, an internal lock, notch, or groove, to secure the extension 410 in place either in the first, retracted position, the second, fully extended position, at one or more of a plurality of positions between the first and second positions, or some combination thereof. In some aspects, there may be a release mechanism to release the securing mechanism and free the extension 410 from the first position or the second position, or any position in between. In some embodiments, the securing mechanism may provide sufficient retention force to allow the alignment device 400 to provide a solid surface for forming a straight seam while maintaining the secure position of the extension 410.

Figure 5B:
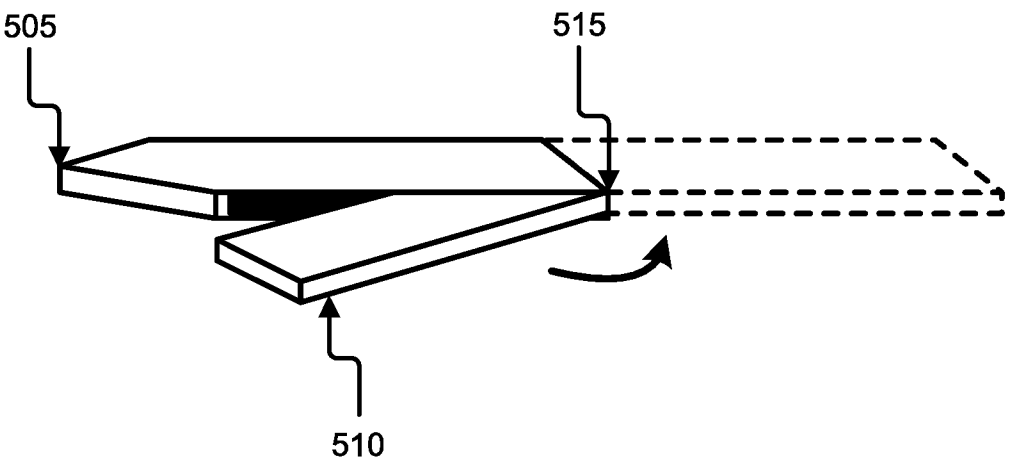
FIG. 5B illustrates a perspective view of an exemplary alignment device comprising an extension, according to some embodiments in the present disclosure.
Figure 5A:
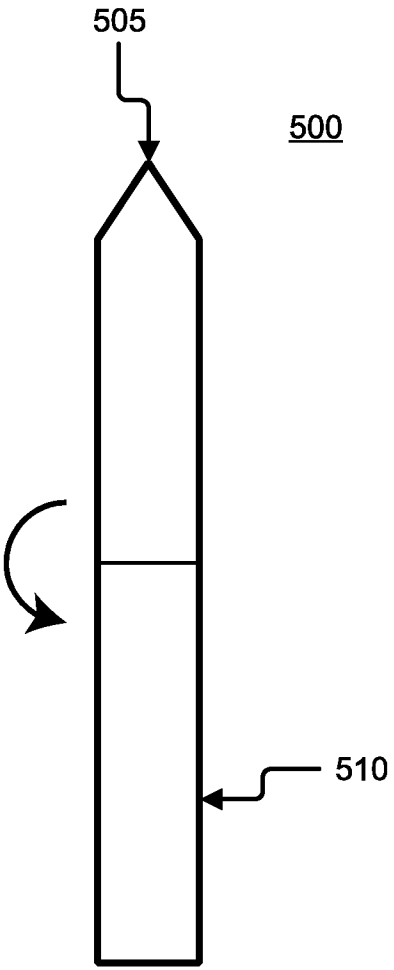
FIG. 5A illustrates an exemplary alignment device comprising an extension, according to some embodiments in the present disclosure.

Referring now to FIGS. 5A-B, an exemplary alignment device 500 is illustrated. In some embodiments, the alignment device 500 may comprise at least one tip 505. In some implementations, the alignment device 500 may comprise at least one internal cavity. In some aspects, the alignment device 500 may comprise one or more extensions 510. In some embodiments, the extension 510 may be coupled to the alignment device 500 by at least one extension mechanism 515.

In some implementations, the extension mechanism 515 may at least partially comprise a swivel hinge, so that the extension 510 is able to fold out from a first, retracted position within the internal cavity to a second, fully extended position to increase the length of the alignment device 500. In some aspects, when the extension 510 is in the second, fully extended position, the length of the alignment device 500 may be doubled. The extension mechanism 515 in the form of a swivel hinge may allow for seamless connectivity in any position by remaining flush with the alignment device 500. In some embodiments, this seamless connectivity may facilitate the formation of a smooth, continuous seam when ironing the inseam.

In some aspects, the extension 510 may comprise the same or a different material from the alignment device 500. The extension 510 may also include one or more measurement systems so that when the extension 510 is in the second, fully extended position, the extension 510 continues the measurement system(s) included on the alignment device 500. In some implementations, if multiple extensions 510 are used, each extension 510 may comprise portions of one or more continuous measurement systems.

Figure 6B:
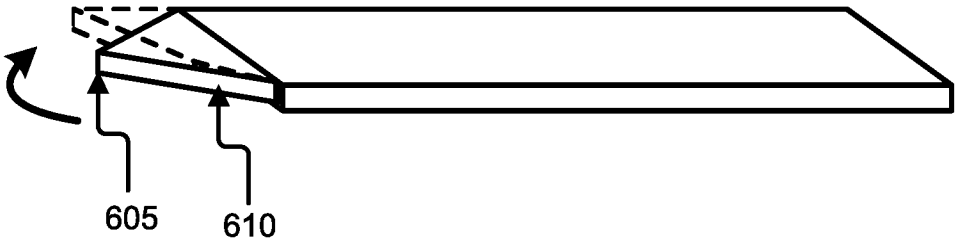
FIG. 6B illustrates a perspective view of an exemplary alignment device comprising an extension that further comprises a tip, according to some embodiments in the present disclosure.
Figure 6A:
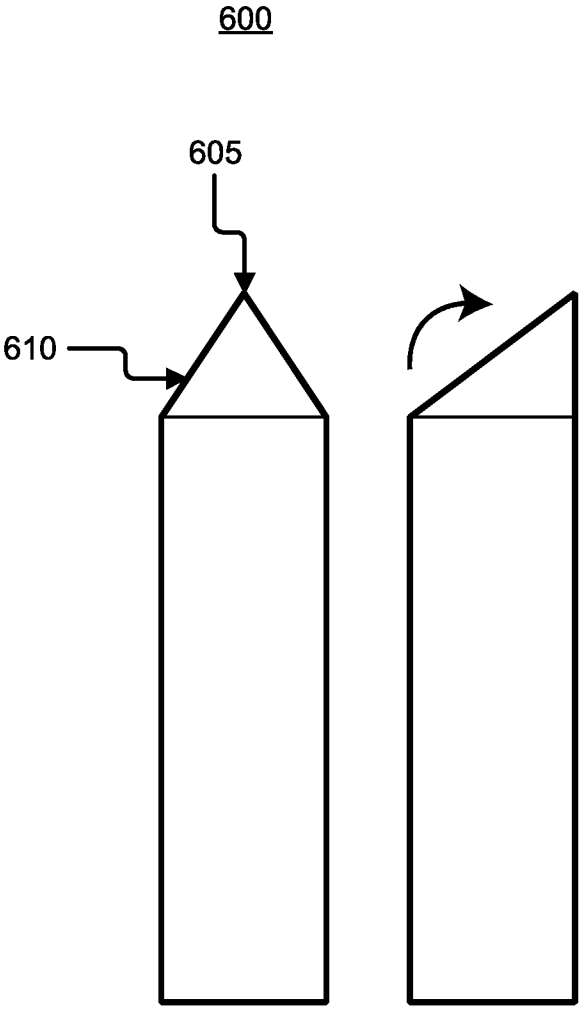
FIG. 6A illustrates an exemplary alignment device comprising an extension that further comprises a tip, according to some embodiments in the present disclosure.

Referring now to FIGS. 6A-B, an exemplary alignment device 600 is illustrated. In some embodiments, the alignment device 600 may comprise one or more extensions 610 that comprises at least one tip 605, wherein the one or more extensions may be rotatable about at least one axis. In some implementations, the at least one tip may comprise a point or a rounded or curved shape. In some aspects, the extension 610 may be coupled to the alignment device 600 by at least one internal extension mechanism.

In some embodiments, an internal cavity within the alignment device 600 may be located proximate to the end of the alignment device 600 comprising the extension 610 that comprises the tip 605. In some implementations, the extension 610 that comprises the tip 605 may be configured to be manipulated by a user to rotate at least partially into and out of the internal cavity to assume one or more different orientations. Rotating the extension 610 that comprises the tip 605 to different orientations may aid a user in guiding the alignment device 600 in sewing applications involving projects of varying widths or angles. In some implementations, the alignment device 600 may comprise at least one internal extension mechanism that rotates about at least one axis and is connected to the extension 610 that comprises the tip 605, thereby allowing movement at least a portion of the extension 610 that comprises the tip 605 into and out of the internal cavity.

Figure 7B:
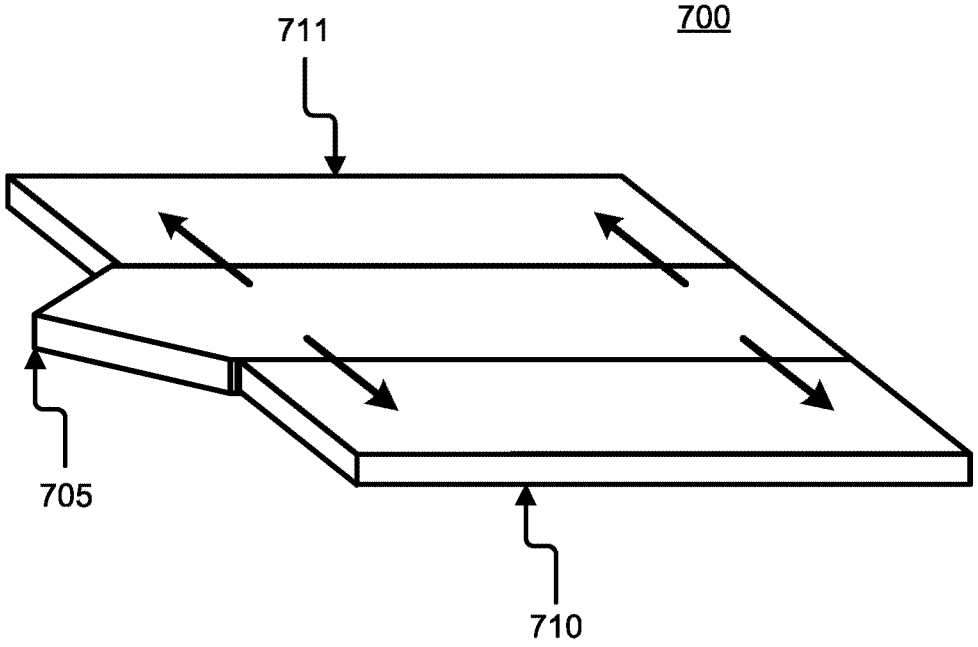
FIG. 7B illustrates a perspective view of an exemplary alignment device comprising a plurality of extensions, according to some embodiments in the present disclosure.
Figure 7A:
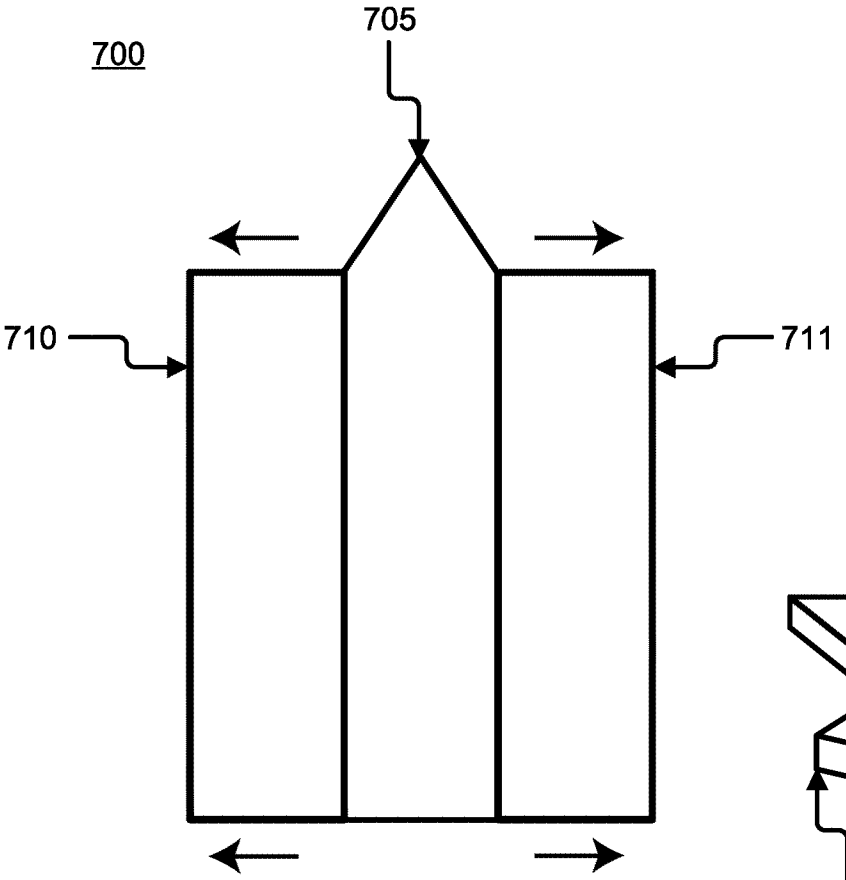
FIG. 7A illustrates an exemplary alignment device comprising a plurality of extensions, according to some embodiments in the present disclosure.

Referring now to FIGS. 7A-B, an exemplary alignment device 700 is illustrated. In some embodiments, the alignment device 700 may comprise at least one tip 705. In some implementations, the at least one tip 705 may comprise a point or a rounded or curved shape. In some aspects, the alignment device 700 may comprise a plurality of extensions 710, 711. In some embodiments, each of the plurality of extensions 710, 711 may comprise a first, retracted position within an internal cavity in the body of the alignment device 700 and may be moveable to a second, extended position outside of the body of the alignment device 700, thereby increasing the total surface area of the alignment device 700. In some implementations, moving the plurality of extensions 710, 711 to the second, extended position may cause the total surface area of the alignment device 700 to be tripled. In some aspects, each of the plurality of extensions 710, 711 may incrementally or freely occupy a plurality of positions between the first position and the second position.

In some embodiments, each the plurality of extensions 710, 711 may be secured into a position via a securing mechanism, such as, by way of example and not limitation, an internal lock, notch, or groove. In some implementations, there may be a release mechanism to release securing mechanism(s) and free each of the plurality of extensions 710, 711 from the first position or the second position, or any position in between. In some aspects, the securing mechanism(s) may provide sufficient retention force to allow the alignment device 700 to provide a solid surface for forming a straight seam while maintaining the secure position of each of the plurality of extensions 710, 711.

Figure 8A:
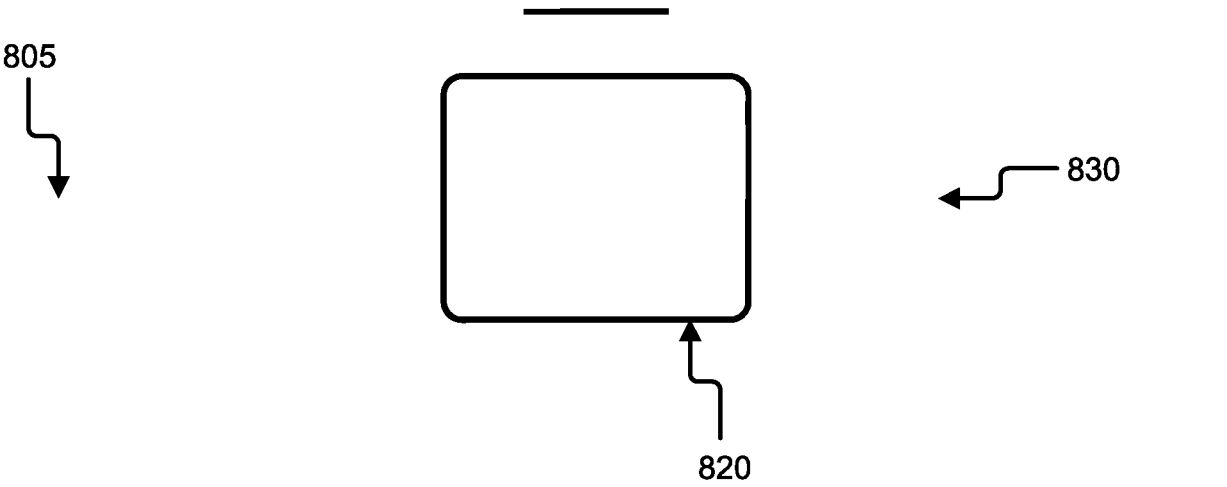
FIG. 8A illustrates an exemplary alignment device comprising a hole and a sleeve, according to some embodiments in the present disclosure.
Figure 8B:
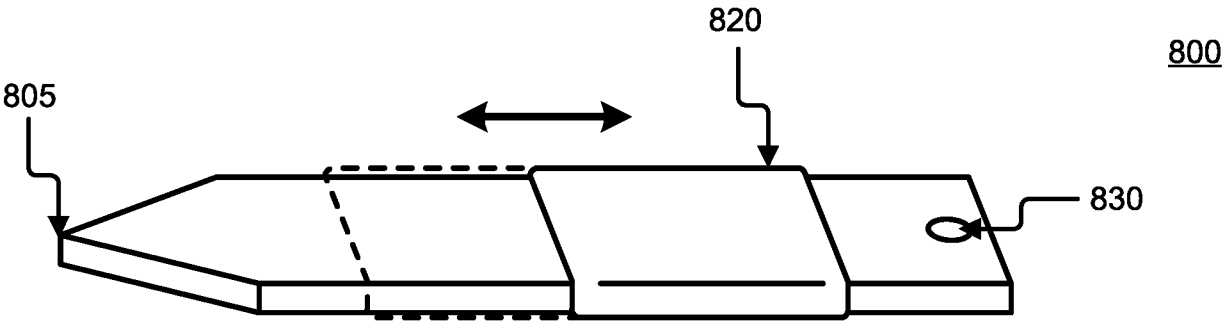
FIG. 8B illustrates a perspective view of an exemplary alignment device comprising a hole and a sleeve, according to some embodiments in the present disclosure.

Referring now to FIGS. 8A-B, an exemplary alignment device 800 is illustrated. In some embodiments, the alignment device 800 may comprise at least one removable sleeve 820. In some implementations, the alignment device 800 may comprise at least one hole 830. In some aspects, the at least one hole 830 may be proximate to a distal end of the alignment device 800, such as the first or second distal end. In some embodiments, the sleeve 820 may encircle at least a portion of the body of the alignment device 800. In some implementations, the sleeve 820 may partially or wholly enclose the body of the alignment device 800. In some aspects, the sleeve 820 may incrementally or freely slide up and down the body of the alignment device 800, as non-limiting alternatives. In some embodiments, the sleeve 820 may increase the overall thickness of the alignment device 800. In some implementations, the sleeve 820 may comprise a coefficient of friction that is greater than the coefficient of friction of the top planar surface and the bottom planar surface of the alignment device 800.

In some embodiments, the hole 830 may allow a user to store the alignment device 800 on a hook, peg, or other non-limiting equivalent structure. This may allow for ease of access and, if the alignment device 800 comprises a patterned material, may add an aesthetic feature to the user's room. In some implementations, the hole 830 may allow the user to reach more deeply into a longer sewing project by threading and tying a string through the hole 830 and subsequently retracting the alignment device from the sewing project via pulling the tied string, as a non-limiting example.

Figure 9A:
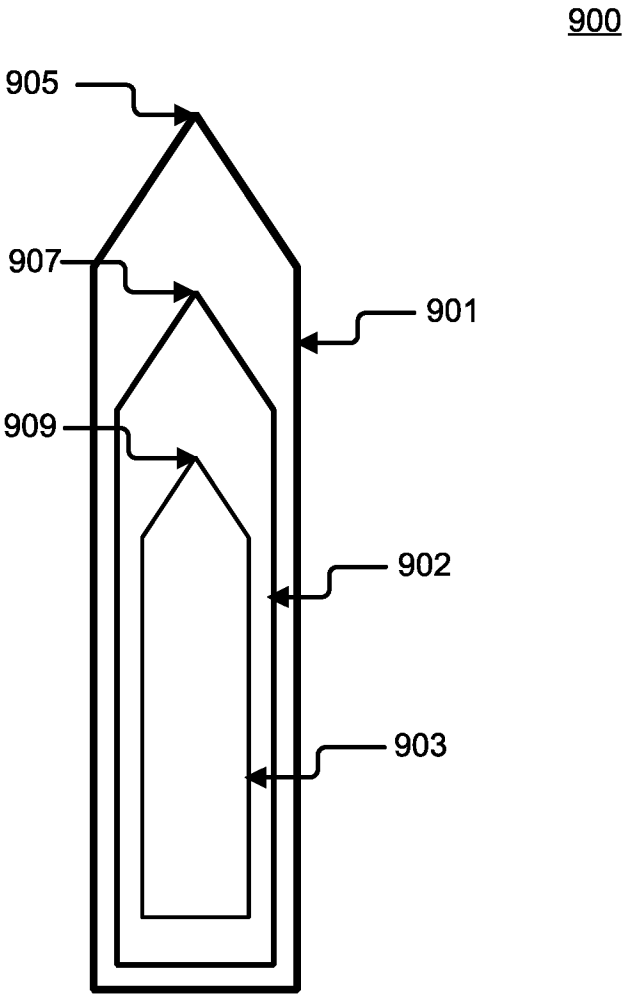
FIG. 9A illustrates an exemplary alignment system comprising a plurality of exemplary alignment devices, according to some embodiments in the present disclosure.
Figure 9B:
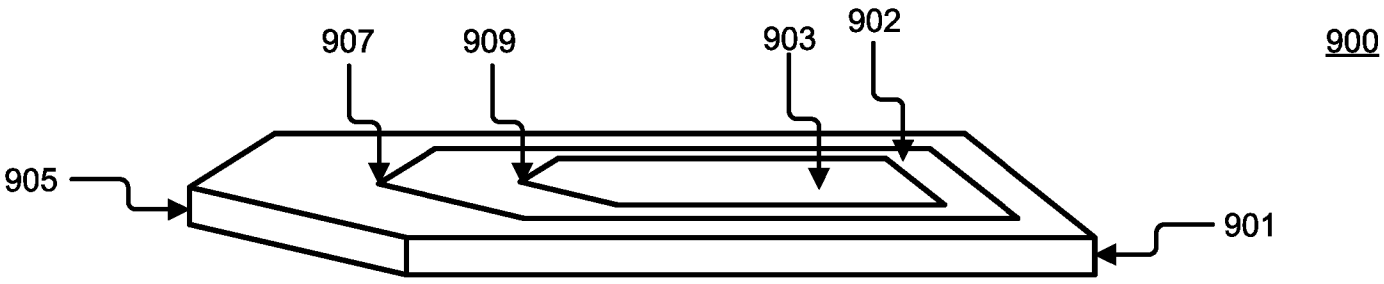
FIG. 9B illustrates a perspective view of an exemplary alignment system comprising a plurality of exemplary alignment devices, with some of the exemplary alignment devices comprising a recess, according to some embodiments in the present disclosure.
Figure 9C:
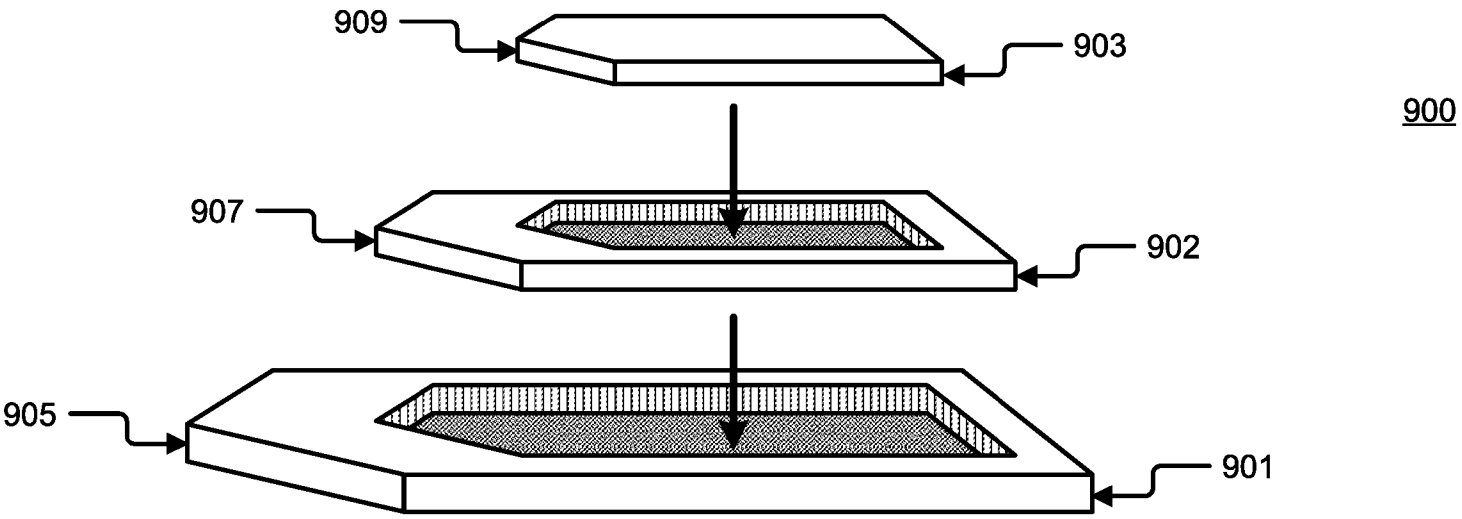
FIG. 9C illustrates a perspective view of an exemplary alignment system comprising a plurality of exemplary alignment devices, with some of the alignment devices comprising a recess, according to some embodiments in the present disclosure.
Figure 10A:
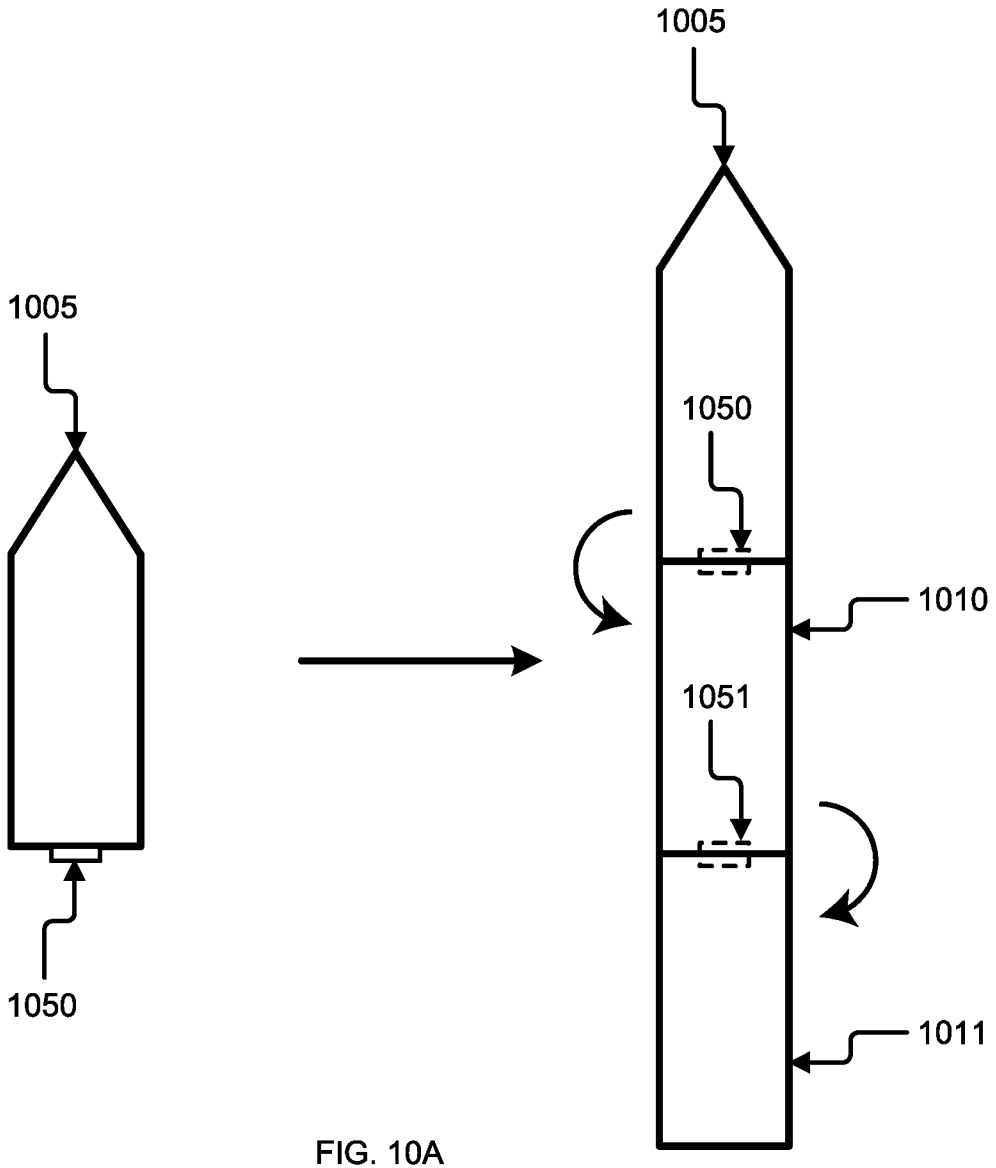
FIG. 10A illustrates an exemplary alignment device comprising a plurality of connecting bodies and a plurality of connection mechanisms, according to some embodiments in the present disclosure.
Figure 10B:
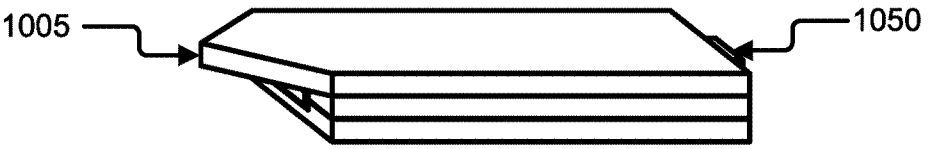
FIG. 10B illustrates a perspective view of an exemplary alignment device comprising a plurality of connecting bodies and a plurality of connection mechanisms, according to some embodiments in the present disclosure.
Figure 10C:
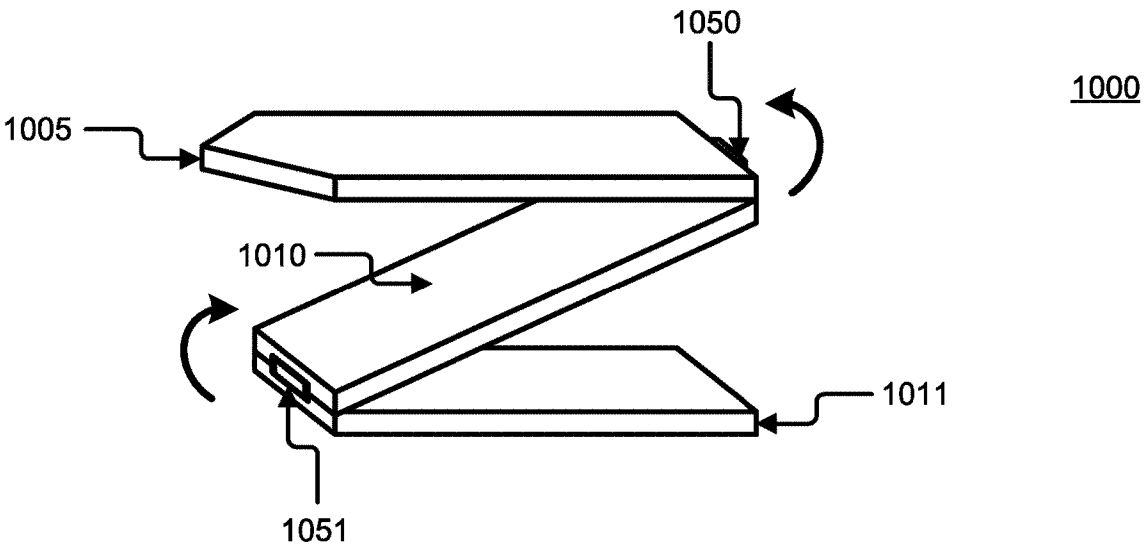
FIG. 10C illustrates a perspective view of an exemplary alignment device comprising a plurality of connecting bodies and a plurality of connection mechanisms, according to some embodiments in the present disclosure.
Figure 10D:
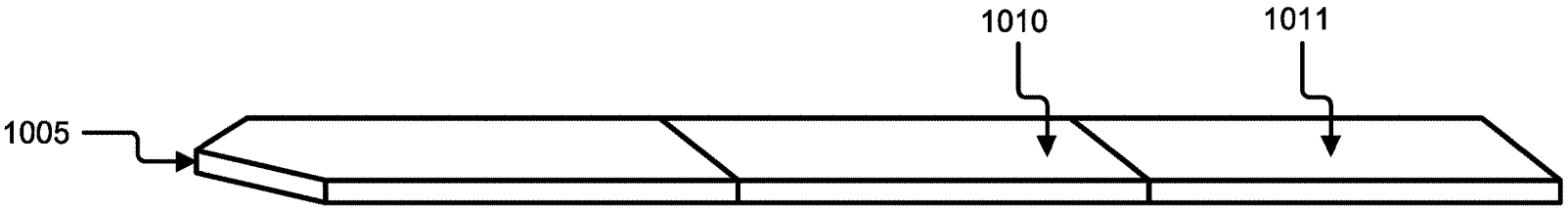
FIG. 10D illustrates a perspective view of an exemplary alignment device comprising a plurality of connecting bodies and a plurality of connection mechanisms, according to some embodiments in the present disclosure.

Referring now to FIGS. 9A-C, an exemplary alignment system 900 is illustrated. In some embodiments, the alignment system 900 may comprise a plurality of alignment devices 901, 902, 903 of varying sizes. In some implementations, each of the plurality of alignment devices 901, 902, 903 may comprise at least one tip 905, 907, 909. In some aspects, the at least one tip 905, 907, 909 may comprise a point or a rounded or curved shape. In some embodiments, one or more of the plurality of alignment devices 901, 902 may comprise one or more recesses within a top or bottom surface of the alignment device 901, 902.

For example, alignment device 901 may be the largest in the alignment system. In some aspects, alignment device 901 may comprise a recess in its surface that allows smaller alignment device 902 to fit snuggly therein during storage or in a situation where the user may only want to use alignment device 901. In some embodiments, alignment device 902 may comprise a recess in its top or bottom surface that allows still smaller alignment device 903 to fit snuggly therein during storage or in a situation where the user may only want to use alignment device 901 and/or 902.

In some implementations, each recess within the top or bottom surface of the nesting alignment device 901, 902 may be configured so as not to disrupt the flush, uniform surface of the alignment devices 901, 902. As an example, the alignment devices 902, 903 may comprise different thicknesses so that, when nested within another alignment device 901, 902, the nested surface remains smooth. As another example, in embodiments wherein the alignment devices 901, 902 may each include one or more measurement systems, the measurement system(s) may be fixed upon or within the smooth, opposite surface of the alignment devices 901, 902 that does not comprise the recess.

Referring now to FIGS. 10A-D, an exemplary alignment device 1000 is illustrated. In some embodiments, the alignment device 1000 may comprise a plurality of connecting bodies 1010, 1011. In some aspects, a connection mechanism 1050, 1051 may couple each of connecting bodies 1010, 1011 to the alignment device 1000 and to an adjacent connecting body 1010, respectively.

For example, the alignment device 1000 may fold and unfold on top of connecting bodies 1010, 1011. In some embodiments, the alignment device 100 may stack on top of connecting bodies 1010, 1011 in a first closed position. In some implementations, the alignment device 1000 may increase in length when the connecting bodies 1010, 1011 are unfolded and the connection mechanisms 1050, 1051 stabilize the connecting bodies 1010, 1011 in a second, fully extended position. In some aspects, the alignment device 1000 may triple in length when the connecting bodies 1010, 1011 are in the second position.

In some embodiments, the connection mechanisms 1050, 1051 may at least partially comprise hinges or similar elements that unfold to lay flush with the alignment device 1000. In some aspects, the alignment device 1000 may comprise at least one attachment mechanism that holds the connecting bodies 1010, 1011 in place in the first, closed position. This attachment mechanism may comprise buttons, snap-closures, magnets, or other non-limiting examples.

In some embodiments, the alignment device 1000 may comprise a first body, where the first body comprises a first distal end, the first distal end of the first body comprising at least one tip 1005, wherein one or more edges of the first distal end of the first body converge at the tip 1005, which may comprise a point or a rounded or curved shape. In some aspects, the first body may comprise a second distal end, wherein the second distal end of the first body may comprise one or more edge portions. In some implementations, the second distal end of the first body may comprise at least one receiving portal configured to removably receive at least one connection mechanism 1050. In some embodiments, the first body may comprise a top planar surface, wherein the top planar surface of the first body comprises a smooth, continuous plane that spans an area bounded by the first distal end of the first body, the second distal end of the first body, and two substantially straight side portions on opposing sides of the first body and extending from the first distal end of the first body to the second distal end of the first body.

In some aspects, the first body may comprise a bottom planar surface, wherein the bottom planar surface of the first body is congruent with the top planar surface of the first body and spans the area bounded by the first distal end of the first body, the second distal end of the first body, and the two straight side portions of the first body.

In some implementations, the alignment device 1000 may comprise a plurality of connecting bodies 1010, 1011. In some aspects, a connecting body 1010 may comprise a first distal end comprising a connection mechanism 1050, wherein the connection mechanism 1050 may be configured to attach the plurality of connecting bodies 1010, 1011 to the first body.

In some embodiments, a connecting body 1010 may comprise a top planar surface, wherein the top planar surface of connecting body 1010 comprises a smooth, continuous plane that spans an area bounded by the first distal end of connecting body 1010, a second distal end of connecting body 1010, and two substantially straight side portions on opposing sides of connecting body 1010 and extending from the first distal end of connecting body 1010 to the second distal end of connecting body 1010. In some aspects, the top planar surface of connecting body 1010 is congruent with the top planar surface of the first body. In some implementations, the second distal end of connecting body 1010 may comprise at least one receiving portal, wherein the at least one receiving portalv may be configured to removably receive the connection mechanism 1051 of an adjacent connecting body 1011. In some embodiments, the top planar surface of connecting body 1010 may be parallel to the top planar surface of the first body and/or the top planar surface of an adjacent connecting body 1011 when connecting body 1010 is attached thereto.

Figure 11:
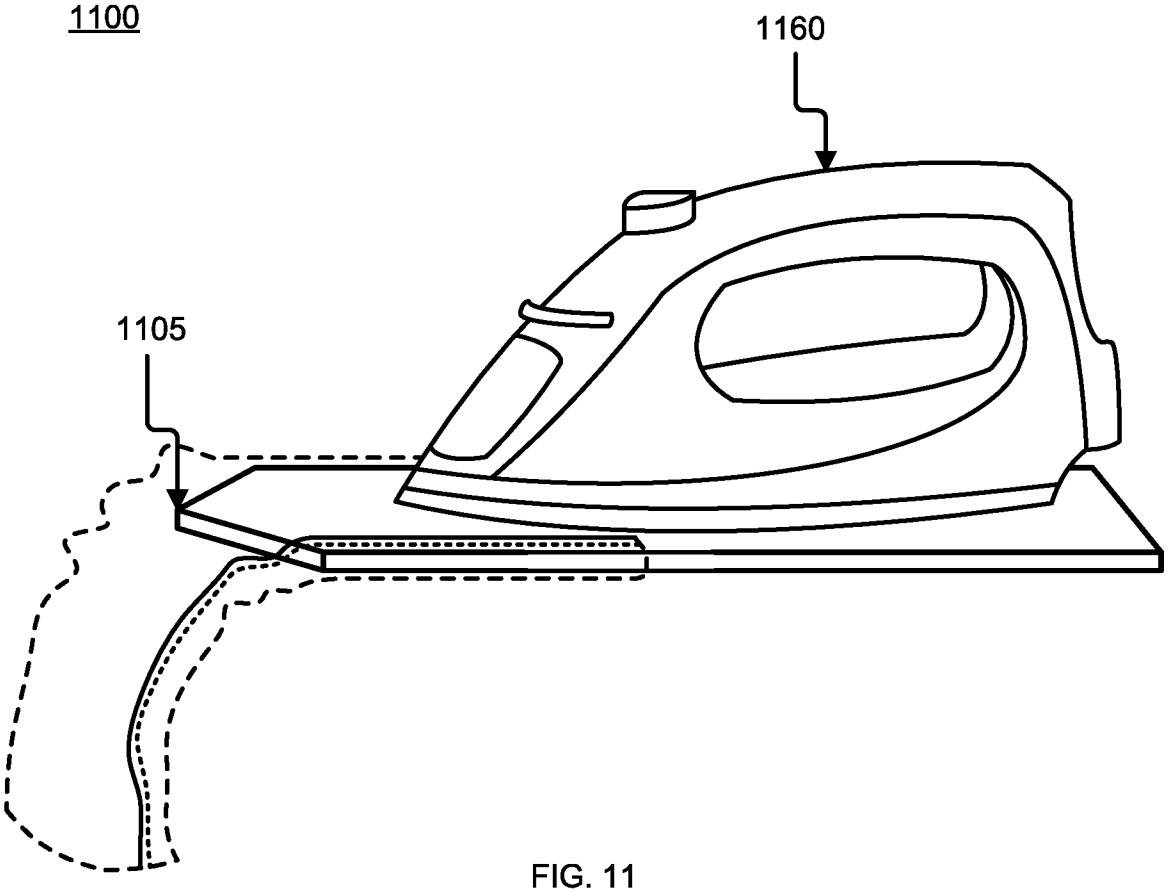
FIG. 11 illustrates a side view of an exemplary alignment device interfacing with an external device, according to some embodiments in the present disclosure.

Referring now to FIG. 11, an exemplary alignment device 1100 interfacing with an external device 1160 is illustrated. In some embodiments, the alignment device 1100 may be safely used with heat. The heat may allow the alignment device 1100 to provide a predetermined shape for the conforming of the seam of the ironed fabric. The heat source may be an external device 1160, such as an iron. For example, in some implementations, the alignment device 1100 may at least partially comprise a heat-resistant material that may allow a user to handle the alignment device 1100 while and even immediately after interfacing with an iron. In some implementations, the alignment device 1100 may at least partially comprise one or more magnets that may interact with an external device 1160, such as an iron, to assist in facilitating proper inseam alignment.

Figures 12A, 12B, 12C:
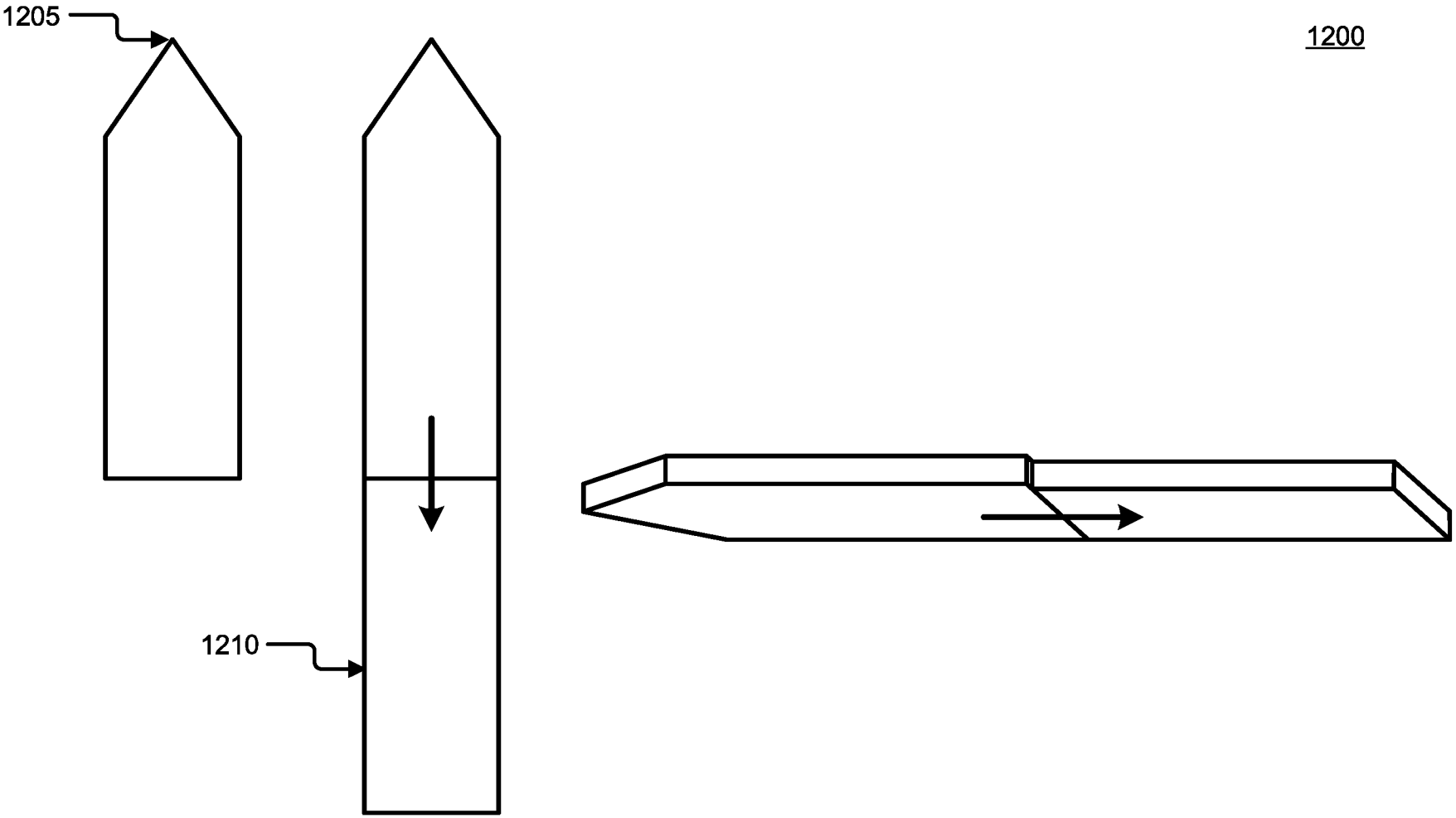
FIG. 12A illustrates an exemplary alignment device comprising an extension, according to some embodiments in the present disclosure.
FIG. 12B illustrates an exemplary alignment device comprising an extension, according to some embodiments in the present disclosure.
FIG. 12C illustrates a perspective view of an exemplary alignment device comprising an extension, according to some embodiments in the present disclosure.

Referring now to FIGS. 12A-C, an exemplary alignment device 1200 comprising an extension 1210 is illustrated. In some embodiments, the alignment device 1200 may comprise at least one tip 1205. In some implementations, the extension 1210 may extend from one of the edges of the alignment device 1200. In some aspects, the alignment device 1200 may comprise at least one substantially hollow inner cavity. In some embodiments, the at least one tip may comprise a point or a rounded or curved shape.

In some embodiments, the extension 1210 may be stored within the hollow cavity of the alignment device 1200. In some implementations, the extension 1210 may be extruded from the alignment device 1200, such as by sliding the extension 1210 out from a rear distal edge of the alignment device 1200, until the extension 1210 is fully extruded, as a non-limiting example. When the extension 1210 is fully extruded, the top surface of the extension 1210 may become flush with the top surface of the alignment device 1200 to allow for smooth transitions between the top surface of the alignment device 1200 and the top surface of the extension 1210 for applications such as ironing.

Figures 13A, 13B, 13C:
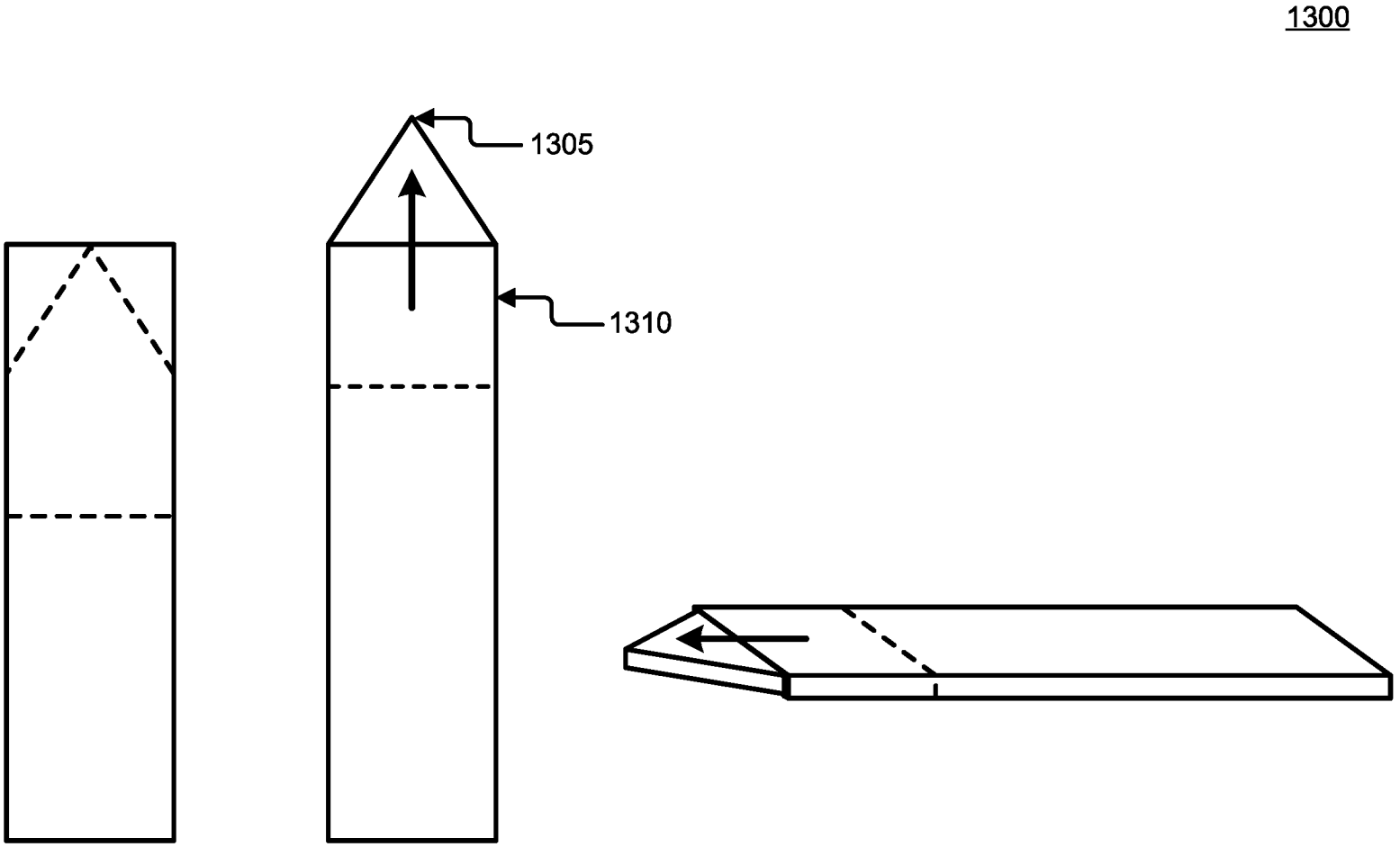
FIG. 13A illustrates an exemplary alignment device comprising an extension that further comprises a tip, according to some embodiments in the present disclosure.
FIG. 13B illustrates an exemplary alignment device comprising an extension that further comprises a tip, according to some embodiments in the present disclosure.
FIG. 13C illustrates a perspective view of an exemplary alignment device comprising an extension that further comprises a tip, according to some embodiments in the present disclosure.

Referring now to FIGS. 13A-C, an exemplary alignment device 1300 comprising an extension 1310 that further comprises a tip 1305 is illustrated. In some implementations, the extension 1310 may extend from one of the edges of the alignment device 1300. In some aspects, the alignment device 1300 may comprise at least one substantially hollow inner cavity. In some embodiments, the tip 1305 may comprise a point or a rounded or curved shape.

In some embodiments, the extension 1310 may be stored within the hollow cavity of the alignment device 1300. In some implementations, the extension 1310 may be extruded from the alignment device 1300, such as by sliding the extension 1310 out from a front distal edge of the alignment device 1300, until the extension 1310 is fully extruded, as a non-limiting example. When the extension 1310 is fully extruded, the top surface of the extension 1310 may become flush with the top surface of the alignment device 1300 to allow for smooth transitions between the top surface of the alignment device 1300 and the top surface of the extension 1310 for applications such as ironing.

Figures 14A, 14B, 14C:
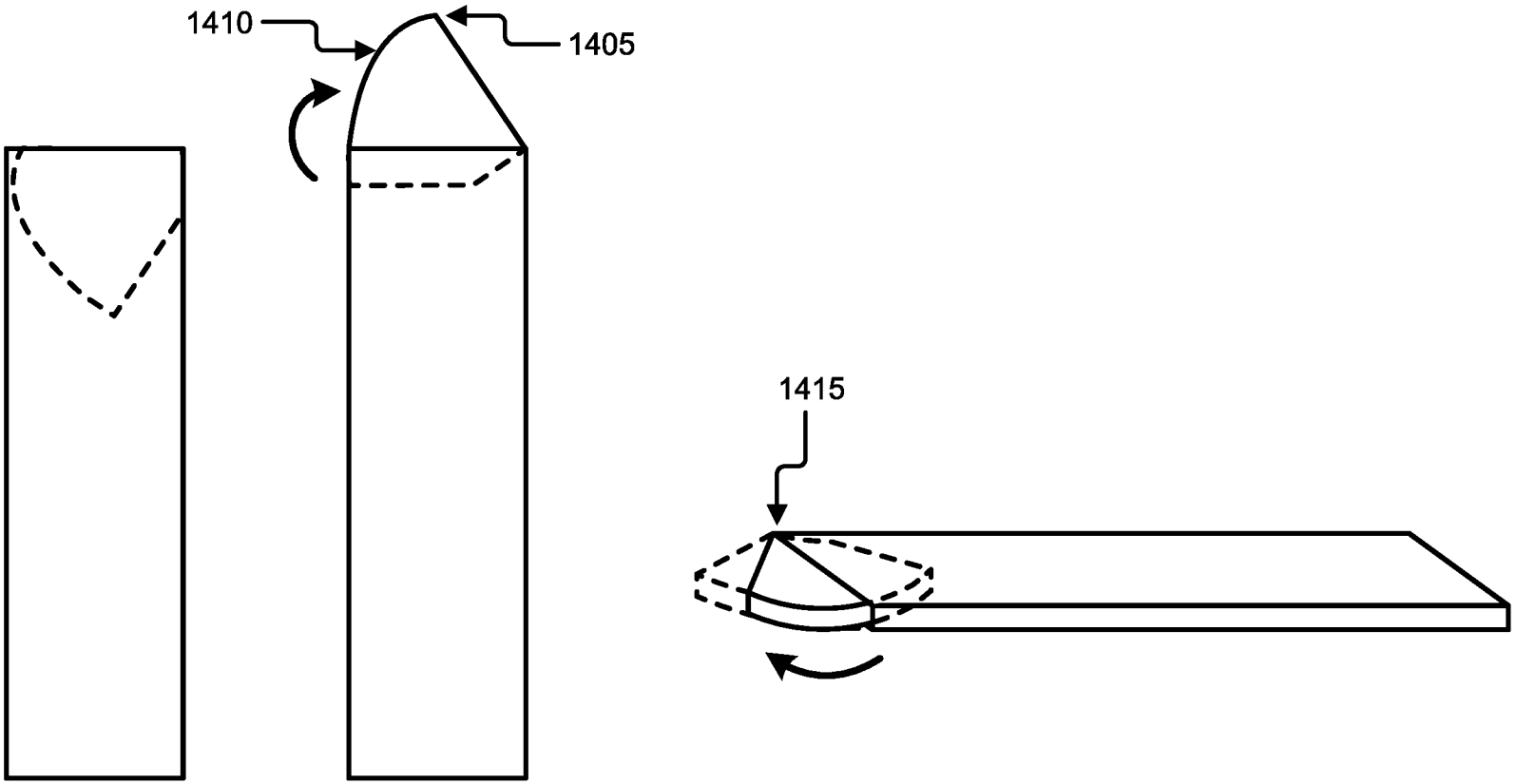
FIG. 14A illustrates an exemplary alignment device comprising an extension that further comprises a tip, according to some embodiments in the present disclosure.
FIG. 14B illustrates an exemplary alignment device comprising an extension that further comprises a tip, according to some embodiments in the present disclosure.
FIG. 14C illustrates a perspective view of an exemplary alignment device comprising an extension that further comprises a tip, according to some embodiments in the present disclosure.

Referring now to FIGS. 14A-C, an exemplary alignment device 1400 comprising an extension 1410 that further comprises a tip 1405 is illustrated. In some embodiments, the alignment device 1400 may comprise at least one extension mechanism 1415 located proximate to one or more edges of a first distal end at a front portion of the alignment device 1400. In some implementations, the extension 1410 may extend from one of the edges of the alignment device 1400. In some aspects, the alignment device 1400 may comprise at least one substantially hollow inner cavity. In some embodiments, the tip 1405 may comprise a point or a rounded or curved shape.

In some embodiments, the extension 1410 may be stored within the hollow cavity of the alignment device 1400. In some implementations, the extension 1410 may be extruded from the alignment device 1400 by rotation, such as by rotating the extension 1410 out from a front distal edge of the alignment device 1400, until the extension 1410 is fully extruded, as a non-limiting example. When the extension 1410 is fully extruded, the top surface of the extension 1410 may become flush with the top surface of the alignment device 1400 to allow for smooth transitions between the top surface of the alignment device 1400 and the top surface of the extension 1410 for applications such as ironing.

In some aspects, the extension 1410 may comprise a curved shape in order to accommodate a curved seam profile. In some embodiments, the curvature of the extension 1410 may enable the extension 1410 to navigate curves in sown fabrics, such as the curves in a sewn fabric tubing, as a non-limiting example. In some implementations, the tip 1405 may guide the extension 1410 along the curvature of a sown fabric.

Figures 15A, 15B, 15C:
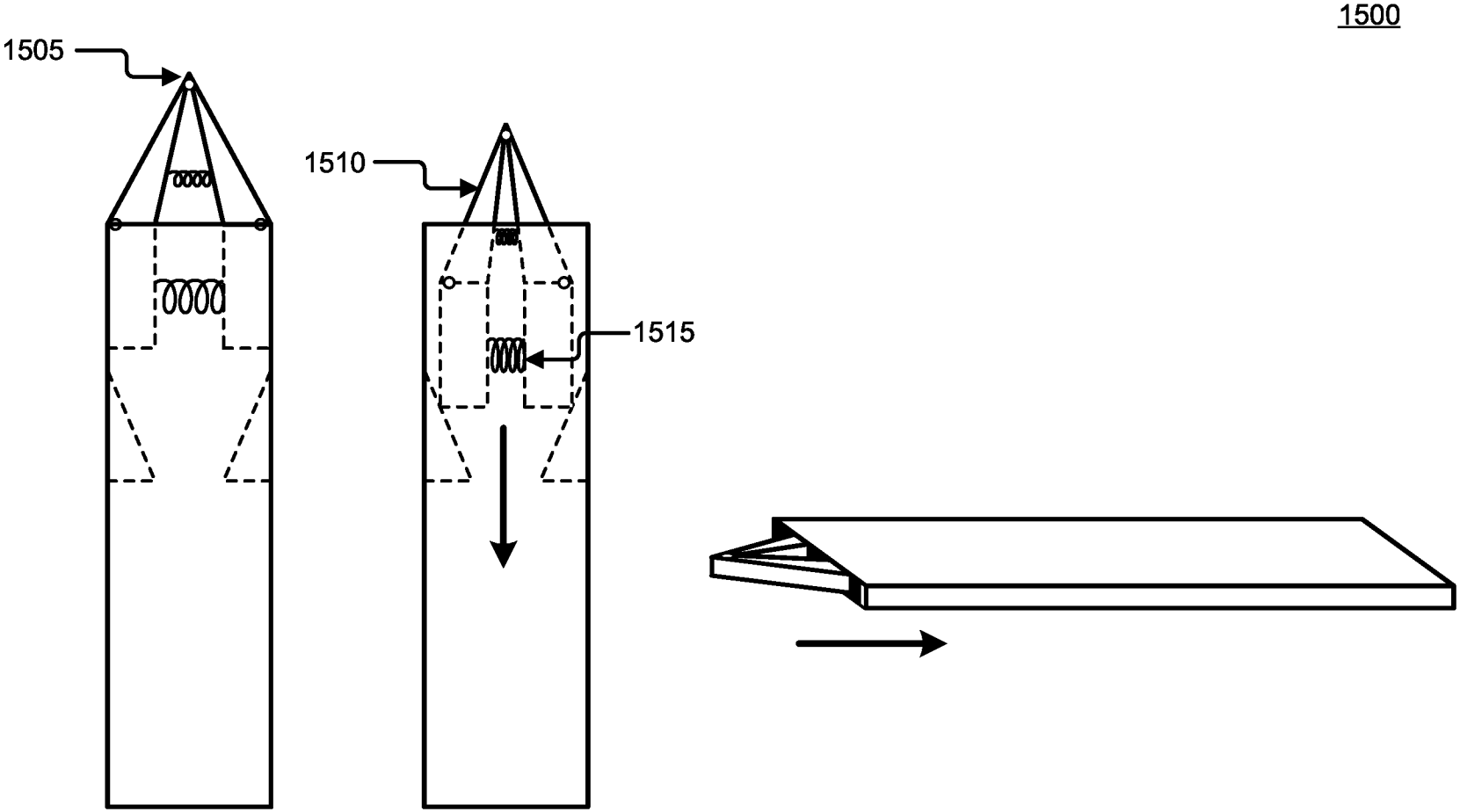
FIG. 15A illustrates an exemplary alignment device comprising an extension that further comprises a tip, according to some embodiments in the present disclosure.
FIG. 15B illustrates an exemplary alignment device comprising an extension that further comprises a tip, according to some embodiments in the present disclosure.
FIG. 15C illustrates a perspective view of an exemplary alignment device comprising an extension that further comprises a tip, according to some embodiments in the present disclosure.

Referring now to FIGS. 15A-C, an exemplary alignment device 1500 comprising an extension 1510 that further comprises a tip 1505 is illustrated. In some embodiments, the alignment device 1500 may comprise at least one extension mechanism 1515 located proximate to one or more edges of a first distal end at a front portion of the alignment device 1500. By way of example and not limitation, the at least one extension mechanism 1515 may at least partially comprise a spring or similar element. In some implementations, the extension 1510 may extend from one of the edges of the alignment device 1500. In some aspects, the alignment device 1500 may comprise at least one substantially hollow inner cavity. In some embodiments, the tip 1505 may comprise a point or a rounded or curved shape.

In some embodiments, the extension 1510 may be stored within the hollow cavity of the alignment device 1500. In some implementations, the extension 1510 may be extruded from the alignment device 1500 by extension, such as by extending the extension 1510 from a front distal edge of the alignment device 1500 when the extension mechanism 1515 is compressed by an external force, until the extension 1510 is fully extruded, as a non-limiting example. In some aspects, compressing the extension mechanism 1515 may also facilitate the retraction of the extension 1510.

When the extension 1510 is fully extruded, the top surface of the extension 1510 may become flush with the top surface of the alignment device 1500 to allow for smooth transitions between the top surface of the alignment device 1500 and the top surface of the extension 1510 for applications such as ironing.

Figures 16A, 16B, 16C:
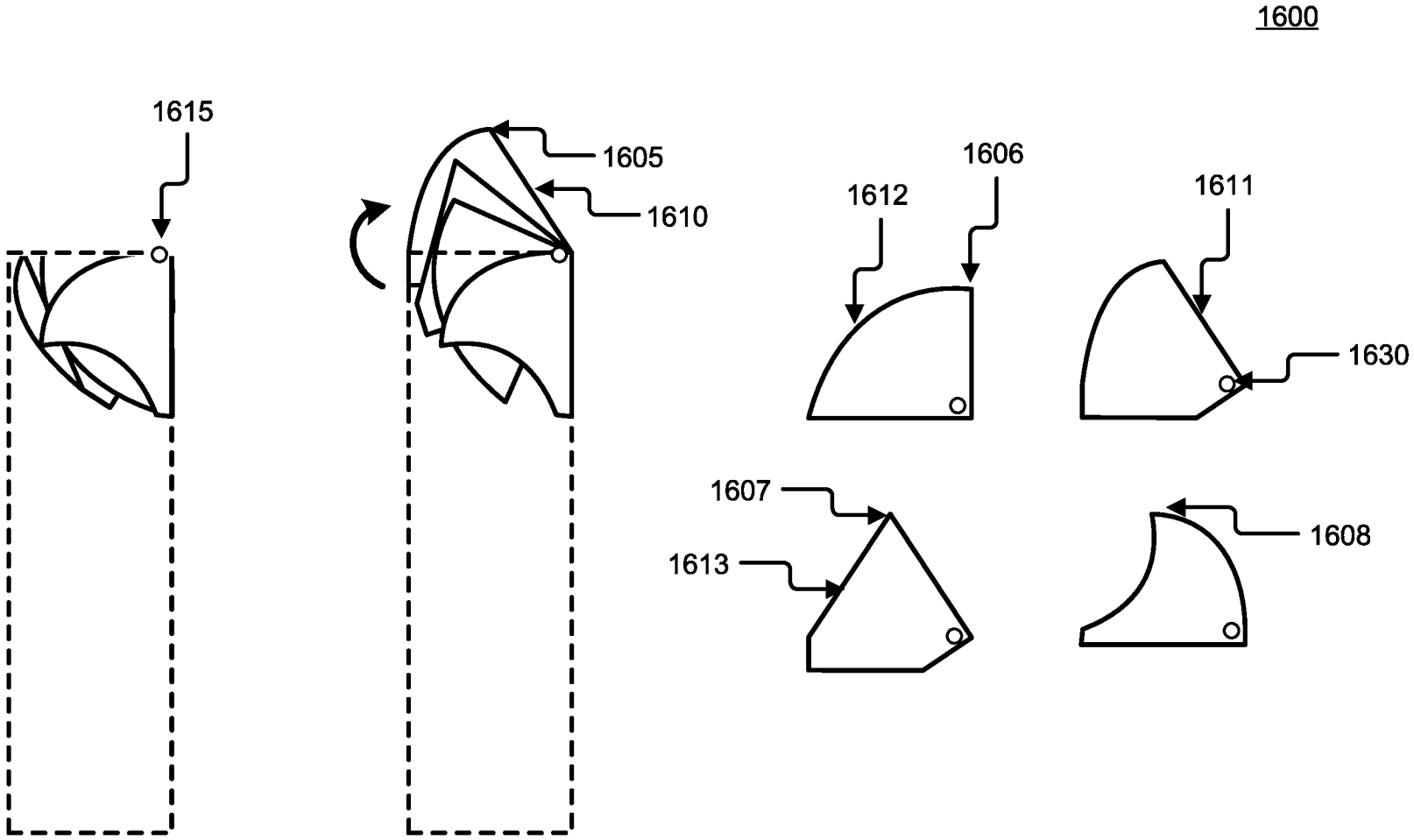
FIG. 16A illustrates an exemplary alignment device comprising a plurality of extensions that comprise tips, according to some embodiments in the present disclosure.
FIG. 16B illustrates an exemplary alignment device comprising a plurality of extensions that comprise tips, according to some embodiments in the present disclosure.
FIG. 16C illustrates a plurality of exemplary tips for an exemplary alignment device, according to some embodiments in the present disclosure.
Figures 18A, 18B, 18C, 18D:
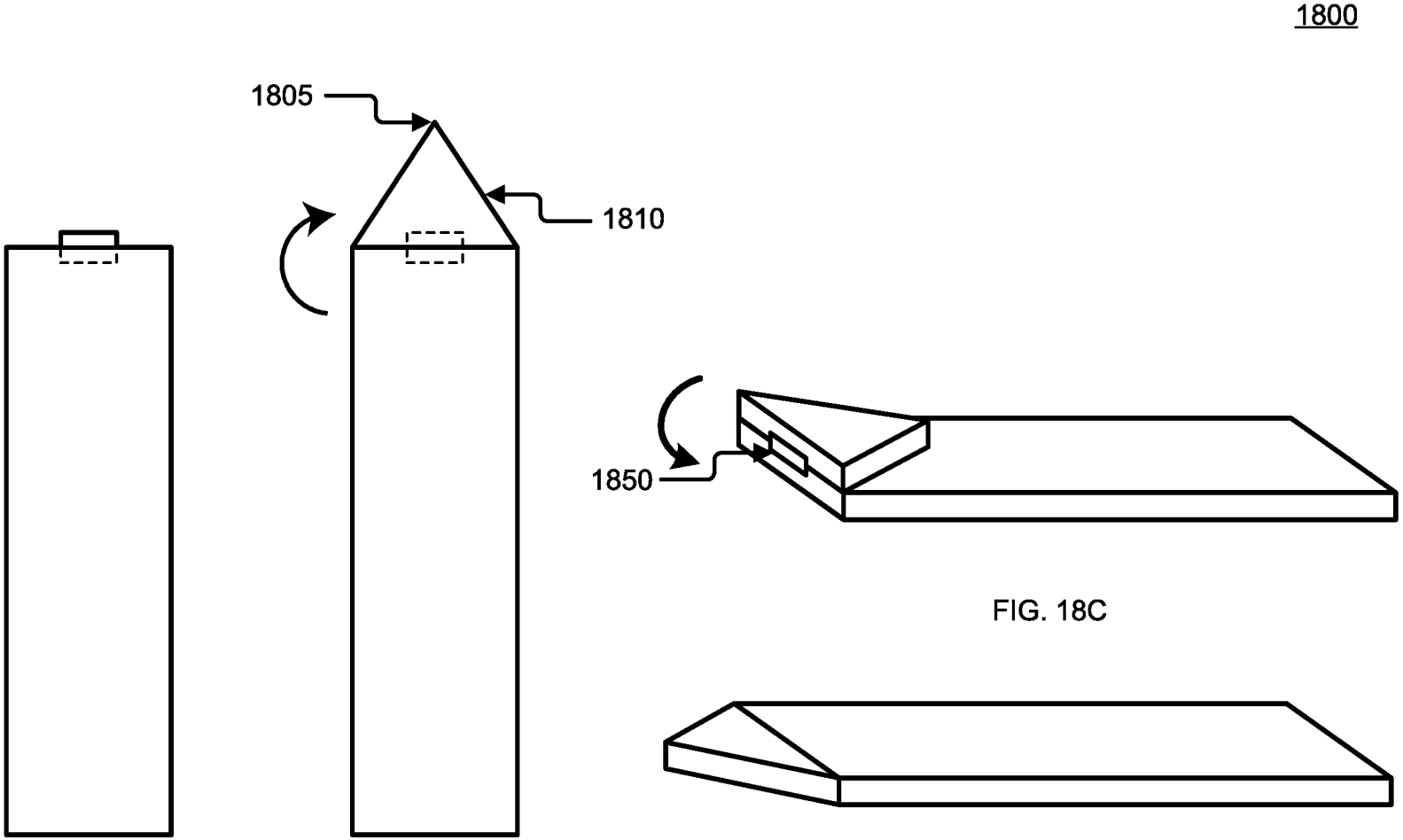
FIG. 18A illustrates an exemplary alignment device comprising an extension that further comprises a tip, according to some embodiments in the present disclosure.
FIG. 18B illustrates an exemplary alignment device comprising an extension that further comprises a tip, according to some embodiments in the present disclosure.
FIG. 18C illustrates a perspective view of an exemplary alignment device comprising an extension that further comprises a tip, according to some embodiments in the present disclosure.
FIG. 18D illustrates a perspective view of an exemplary alignment device comprising an extension that further comprises a tip, according to some embodiments in the present disclosure.

Referring now to FIGS. 16A-C, an exemplary alignment device 1600 comprising a plurality of extensions 1610, 1611, 1612, 1613 that comprise tips 1605, 1606, 1607, 1608 is illustrated. In some embodiments, the alignment device 1600 may comprise at least one extension mechanism 1615 located proximate to one or more edges of a first distal end at a front portion of the alignment device 1600. In some implementations, the extension mechanism 1615 may comprise a hole 1630. In some aspects, the hole 1630 may comprise a rotatable axis that allows each of the plurality of extensions 1610, 1611, 1612, 1613 that comprise tips 1605, 1606, 1607, 1608 to be rotated in and out of storage within the alignment device 1600. In some embodiments, tips 1605, 1606, 1607, 1608 may comprise points or rounded or curved shapes.

In some embodiments, each of the plurality of extensions 1610, 1611, 1612, 1613 may extend from one of the edges of the alignment device 1600. In some aspects, the alignment device 1600 may comprise at least one substantially hollow inner cavity. In some embodiments, each of the plurality of extensions 1610, 1611, 1612, 1613 may be stored within the hollow cavity of the alignment device 1600. In some implementations, each of the plurality of extensions 1610, 1611, 1612, 1613 may be extruded from the alignment device 1600 by rotation, such as by rotating each extension 1610, 1611, 1612, 1613 out from a front distal edge of the alignment device 1600 as needed or desired, until the selected extension 1610, 1611, 1612, 1613 is fully extruded, as a non-limiting example.

When a selected extension 1610, 1611, 1612, 1613 is fully extruded, the top surface of the selected extension 1610, 1611, 1612, 1613 may become flush with the top surface of the alignment device 1600 to allow for smooth transitions between the top surface of the alignment device 1600 and the top surface of the selected extension 1610, 1611, 1612, 1613 for applications such as ironing.

Referring now to FIGS. 17A-D, an exemplary alignment device 1700 comprising a connecting body 1710, 1712, 1713, 1714 that further comprises a tip 1705, 1706, 1707, 1708 is illustrated. In some embodiments, the alignment device 1700 may comprise at least one receiving portal 1740 configured to removably receive at least one connection mechanism 1750. In some implementations, the connecting body 1710, 1712, 1713, 1714 may comprise at least one connection mechanism 1750. In some aspects, the tip 1705, 1706, 1707, 1708 may comprise a point or a rounded or curved shape.

In some embodiments, the connecting body 1710, 1712, 1713, 1714 may comprise a separate, attachable component to one of the edges of the alignment device 1700. In some aspects, the alignment device 1700 may comprise at least one substantially hollow inner cavity.

In some embodiments, the connecting body 1710, 1712, 1713, 1714 may be stored within the hollow cavity of the alignment device 1700. In some implementations, the connecting body 1710, 1712, 1713, 1714 may be extruded from the alignment device 1700 and attached thereto, such as by inserting the connection mechanism 1750 of the connecting body 1710, 1712, 1713, 1714 into a receiving portal 1740 on a front distal edge of the alignment device 1700, until the connecting body 1710, 1712, 1714 is fully attached and secured, as a non-limiting example. When the connecting body 1710, 1712, 1713, 1714 is fully attached, the top surface of the connecting body 1710, 1712, 1713, 1714 may become flush with the top surface of the alignment device 1700 to allow for smooth transitions between the top surface of the alignment device 1700 and the top surface of the connecting body 1710, 1712, 1713, 1714 for applications such as ironing.

In some embodiments, the alignment device 1700 may comprise a first body, wherein the first body comprises a first distal end, wherein the first distal end of the first body comprises at least one receiving portal 1740 configured to removably receive at least one connection mechanism 1750 associated with one or more of a plurality of connecting bodies 1710, 1712, 1713, 1714. In some aspects, the first body may comprise a second distal end, wherein the second distal end of the first body may comprise one or more edge portions. In some implementations, the first body may comprise a top planar surface, wherein the top planar surface of the first body comprises a smooth, continuous plane that spans an area bounded by the first distal end of the first body, the second distal end of the first body, and two substantially straight side portions on opposing sides of the first body and extending from the first distal end of the first body to the second distal end of the first body.

In some aspects, the first body may comprise a bottom planar surface, wherein the bottom planar surface of the first body is congruent with the top planar surface of the first body and spans the area bounded by the first distal end of the first body, the second distal end of the first body, and the two straight side portions of the first body.

In some implementations, the alignment device 1700 may comprise a plurality of connecting bodies 1710, 1712, 1713, 1714. In some aspects, each connecting body 1710, 1712, 1713, 1714 may comprise a first distal end, the first distal end of the connecting body 1710, 1712, 1713, 1714 comprising a tip 1705, 1706, 1707, 1708, and wherein one or more edges of the first distal end of the connecting body 1710, 1712, 1713, 1714 converge at the tip 1705, 1706, 1707, 1708.

In some embodiments, each connecting body 1710, 1712, 1713, 1714 may comprise a top planar surface, wherein the top planar surface of the connecting body 1710, 1712, 1713, 1714 comprises a smooth, continuous plane than spans an area bounded by the first distal end of the connecting body 1710, 1712, 1713, 1714, a second distal end of the connecting body 1710, 1712, 1713, 1714, and two substantially straight side portions on opposing sides of the connecting body 1710, 1712, 1713, 1714 and extending from the first distal end of the connecting body 1710, 1712, 1713, 1714 to the second distal end of the connecting body 1710, 1712, 1713, 1714.

In some aspects, the top planar surface of the connecting body 1710, 1712, 1713, 1714 is congruent with the top planar surface of the first body. In some implementations, the second distal end of each connecting body 1710, 1712, 1713, 1714 may comprise at least one connection mechanism 1750, wherein the connection mechanism 1750 attaches one or more of the plurality of connecting bodies 1710, 1712, 1713, 1714 to the first body. In some embodiments, when one or more of the plurality of connecting bodies 1710, 1712, 1713, 1714 is attached to the first body, the top planar surface of each of the plurality connecting bodies 1710, 1712, 1713, 1714 attached to the first body may be parallel to the top planar surface of the first body.

Referring now to FIGS. 18A-D, an exemplary alignment device 1800 comprising an extension 1810 that further comprises a tip 1805 is illustrated. In some embodiments, the extension 1810 may comprise at least one extension mechanism 1850. In some aspects, the tip 1805 may comprise a point or a rounded or curved shape.

In some implementations, the extension 1810 may extend from one of the edges of the alignment device 1800. In some embodiments, the extension 1810 may be stored within a substantially hollow inner cavity within the alignment device 1800. In some implementations, the extension 1810 may be extruded from the alignment device 1800 by rotation, such as by rotating the extension 1810 out from a front distal edge of the alignment device 1800, until the extension 1810 is fully extruded, as a non-limiting example. When the extension 1810 is fully extruded, the top surface of the extension 1810 may become flush with the top surface of the alignment device 1800 to allow for smooth transitions between the top surface of the alignment device 1800 and the top surface of the extension 1810 for applications such as ironing.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described components and systems can generally be integrated together in a single product or packaged into multiple products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. An alignment device comprising:

at least one body comprising:

a first distal end, the first distal end comprising at least one tip, wherein one or more edges of the first distal end converge at the at least one tip;

a second distal end, wherein the second distal end comprises one or more edge portions;

two substantially straight side portions on opposing sides of the at least one body, the two substantially straight side portions extending from the first distal end to the second distal end;

a top planar surface, wherein the top planar surface spans an area between the first distal end, the second distal end, and the two substantially straight side portions; and a bottom planar surface, wherein the bottom planar surface is congruent with the top planar surface and spans the area between the first distal end, the second distal end, and the two substantially straight side portions the alignment device includes one or more extensions;

wherein the at least one body comprises at least one substantially hollow cavity;

wherein the one or more extensions are stored within the substantially hollow cavity of the at least one body;

wherein the at least one tip is stored within the substantially hollow cavity of the at least one body;

wherein the one or more extensions are attached to the at least one body by at least one extension mechanism;

wherein the at least one extension mechanism at least partially comprises one of a hinge or a spring and is located proximate to the one or more edges of the first distal end;

wherein the one or more extensions comprises the at least one tip and is configured to rotate about an axis to one or more different orientations.

2. The alignment device of claim 1, wherein the alignment device at least partially comprises a magnetic material.

3. The alignment device of claim 1, wherein the at least one body comprises a plurality of bodies, wherein each of the plurality of bodies comprises a different size, wherein each of the plurality of bodies is configured to be contained within a recess formed within the top planar surface or bottom planar surface of a larger at least one body.

4. The alignment device of claim 1, wherein the at least one body comprises at least one hole, wherein the at least one hole is proximate to the second distal end.

5. The alignment device of claim 1, wherein the at least one body comprises at least one removable sleeve, wherein the at least one removable sleeve encloses at least a portion of the at least one body.

6. The alignment device of claim 5, wherein the at least one removable sleeve increases the thickness of the alignment device and has a coefficient of friction that is greater than a coefficient of friction of the top planar surface and the bottom planar surface.

7. An alignment device comprising:

a first body, the first body comprising:

a first distal end, the first distal end of the first body comprising at least one tip, wherein one or more edges of the first distal end of the first body converge at the at least one tip;

a second distal end, wherein the second distal end of the first body comprises one or more edge portions and at least one receiving portal;

two substantially straight side portions on opposing sides of the first body, the two substantially straight side portions of the first body extending from the first distal end of the first body to the second distal end of the first body;

a top planar surface, wherein the top planar surface of the first body spans an area between the first distal end of the first body, the second distal end of the first body, and the two substantially straight side portions of the first body;

a bottom planar surface, wherein the bottom planar surface of the first body is congruent with the top planar surface of the first body and spans the area between the first distal end of the first body, the second distal end of the first body, and the two substantially straight side portions of the first body; and at least one connecting body, comprising:

a first distal end comprising at least one connection mechanism;

a second distal end comprising at least one receiving portal, wherein inserting the at least one connection mechanism of the at least one connecting body into the receiving portal of the first body or an adjacent connecting body attaches the at least one connecting body to the first body or the adjacent connecting body, respectively;

two substantially straight side portions on opposing sides of the at least one connecting body, the two substantially straight side portions of the at least one connecting body extending from the first distal end of the at least one connecting body to the second distal end of the at least one connecting body;

a top planar surface, wherein the top planar surface of the at least one connecting body spans an area between the first distal end of the at least one connecting body, the second distal end of the at least one connecting body, and the two substantially straight side portions of the at least one connecting body.

8. The alignment device of claim 7, wherein the at least one tip comprises a point.

9. The alignment device of claim 7, wherein the at least one tip comprises a rounded or curved shape.

10. The alignment device of claim 7, wherein the top planar surface of the first body and the top planar surface of the at least one connecting body are parallel when the first body is connected to the at least one connecting body.

* * * * *